US007252260B2

(12) United States Patent
Kato

(10) Patent No.: US 7,252,260 B2
(45) Date of Patent: Aug. 7, 2007

(54) WINDING METHOD AND WINDING APPARATUS

(75) Inventor: Yoshio Kato, Inazawa (JP)

(73) Assignee: Sanko Kiki Co., Ltd., Inazawa-shi (JP)

( * ) Notice: Subject to any disclaimer, the term of this patent is extended or adjusted under 35 U.S.C. 154(b) by 56 days.

(21) Appl. No.: 11/183,862

(22) Filed: Jul. 19, 2005

(65) Prior Publication Data

US 2006/0231669 A1 Oct. 19, 2006

(30) Foreign Application Priority Data

Mar. 24, 2005 (JP) ..... 2005-086056

(51) Int. Cl.
*B21C 47/14* (2006.01)

(52) U.S. Cl. ..... 242/439.4

(58) Field of Classification Search ..... 242/437, 242/439, 439.4, 439.5, 439.6
See application file for complete search history.

(56) References Cited

U.S. PATENT DOCUMENTS 1,786,102 A * 12/1930 Wieghardt et al. ..... 57/15
3,111,803 A * 11/1963 Haugwitz ..... 242/439.5
3,344,592 A * 10/1967 Geisinger ..... 57/3
3,431,158 A * 3/1969 Poulsen ..... 242/439.5
3,507,137 A * 4/1970 Robinson et al. ..... 72/148
3,880,688 A * 4/1975 Calori et al. ..... 156/190
4,388,799 A * 6/1983 Vives ..... 242/439.5
4,668,544 A * 5/1987 Takahashi ..... 428/593
5,232,026 A 8/1993 Hensel et al.
5,265,814 A * 11/1993 Stralka ..... 242/439.5
5,490,318 A 2/1996 Kleinschmidt
5,749,537 A * 5/1998 Muzio et al. ..... 242/439.5
5,820,717 A * 10/1998 Siegenthaler ..... 156/136
7,090,162 B2 * 8/2006 Kim et al. ..... 242/441.1

FOREIGN PATENT DOCUMENTS

JP 11-98779 4/1999
JP 3550372 4/2004

* cited by examiner

*Primary Examiner*—Emmanuel M Marcelo
(74) *Attorney, Agent, or Firm*—Oblon, Spivak, McClelland, Maier & Neustadt, P.C.

(57) ABSTRACT

Provided are a winding method and a winding apparatus in which it makes possible to expedite the winding cycle with a relatively simple construction.

In a winding method in which a plurality of conductor wires are arranged in parallel and wound around a reel to form a coil, which is dropped into a coil receiving jig, the plurality of conductor wires are temporarily wound around a bobbin, and the bobbin is attached to a flyer of a winding apparatus. The flyer is rotated to wind the plurality of conductor wires around the reel while drawing them out of the bobbin.

19 Claims, 27 Drawing Sheets

WINDING METHOD AND WINDING APPARATUS

BACKGROUND OF THE INVENTION

1. Field of the Invention

The present invention relates to a winding method and a winding apparatus in which a plurality of conductor wires are wound in parallel around a reel to form a coil, which is dropped into a coil receiving jig.

2. Description of the Related Prior Art

Recently, in developing a motor for electric cars or the like, there is a demand for a motor which can provide a large driving force by increasing the sectional area of the electric wire and causing large current to flow through the same, so that a large driving force may be obtained from a low-voltage electric source that can be mounted in a vehicle. However, an increase in diameter of electric wire makes it rather difficult to perform winding operation and the operation of inserting the coil into the stator core. Further, it has a problem in that the space factor (filling factor) of the electric wire in the slot of the stator core would decline.

In view of this, there has been made an attempt to form a coil by winding a plurality of electric wires in parallel (through parallel winding) to thereby increase the electric-wire sectional area without difficulties in the winding operation and the coil inserting operation. In such parallel winding, it is impossible to use as it is a conventional winding apparatus that uses a rotary nozzle called a flyer. That is, if a flyer, which winds electric wires around a reel by rotating a nozzle paying out electric wires around the reel, were used, a plurality of electric wires would be twisted like a rope, making it difficult in a post-process to insert the coil obtained into the slot of a stator core by a coil inserting device.

Thus, for example, JP 3550372 B discloses a winding manufacturing system which forms windings for a predetermined number of poles connected to each other by repeating winding formation through winding of wires around a reel and detachment of a winding from the reel, the winding manufacturing system comprising: a winding forming means for forming a winding by winding wires around the reel that rotates; a winding retaining means for retaining a winding detached from the reel upon completion of the winding at a predetermined retaining position corresponding to the pole of the winding; and a positional relationship maintaining means for restraining deviation in the positional relationship between the winding retained by the winding retaining means and the reel on which a winding for another pole is being formed by moving the winding retaining means in synchronism with the rotation of the reel.

Further, JP 11-98779 A discloses a winding apparatus in which a plurality of wires supplied from a flyer through a tension nozzle and arranged in a strip-like fashion are wound around a reel, in which there is rotatably provided a dummy drum coaxial with the reel and with substantially the same peripheral length as the reel, and wherein there is provided a dummy flyer for winding wires around the dummy drum integrally with the flyer, the wires being wound simultaneously around the reel and the dummy drum while moving the tension nozzle upwards and the dummy drum downwards at the same speed in synchronism with the rotation of the flyer and the dummy flyer to thereby facilitate the insertion of the coil into a coil insertion jig while preventing twisting and to attain an improvement in terms of filling factor.

However, in the technique as disclosed in JP 3550372 B, it is necessary to rotate the reel and the winding retaining means in synchronism with each other in order to maintain the connection between the coil already wound and retained by the winding retaining means (coil receiving jig) and the coil formed by being newly wound around the reel, so that it is rather difficult to expedite the winding cycle.

In the technique as disclosed in JP 11-98779 A, in which a dummy drum is arranged above the reel, it is necessary to perform winding simultaneously on the reel and the dummy drum by two flyers, so that the size of the apparatus has to be substantially large especially in the height direction, making the construction rather complicated so the apparatus cost tends to be rather high.

SUMMARY OF THE INVENTION

It is therefore an object of the present invention to provide a winding method and a winding apparatus which make it possible, even through parallel winding, to expedite the winding cycle with a relatively simple construction.

To achieve the above object, there is provided, in accordance with the present invention, a method of winding a plurality of conductor wires arranged in parallel in which the conductor wires are wound around a reel to form a coil and the coil is dropped into a coil receiving jig, the method comprising steps of; (a) providing a bobbin around which the conductor wires are wound; and (b) revolving a flyer of a winding apparatus around the reel in a state in which the bobbin is attached to the flyer, the bobbin being wound the conductor wires around, such that the conductor wires are drawn out of the bobbin to be wound around the reel.

According to the winding method of the present invention, a plurality of conductor wires are temporarily wound around the bobbin, and this bobbin is attached to the flyer of the winding apparatus, and, in this state, the flyer is rotated to wind the plurality of conductor wires around the reel while drawing them out of the bobbin, whereby the plurality of conductor wires can be wound around the reel in parallel arrangement without being twisted. Further, the coils wound around the reel through rotation of the flyer can be successively dropped into the coil receiving jig during winding operation, and the transfer of the coils from the reel to the coil receiving jig can be effected simultaneously, whereby the winding cycle can be expedited.

In accordance with the present invention, there is further provided a method according to the aforementioned method, the method further comprising a step of moving the bobbin from a first position where the conductor wires are wound around the bobbin to a second position where the bobbin is attached to the flyer.

Since, in order to perform the embodiment of the present invention, it is only necessary to add the step of temporarily winding conductor wires around a bobbin and moving to attach this bobbin to a flyer, the winding apparatus for the method can be constructed with a relatively simple structure.

According to the present invention, in the method of winding a plurality of conductor wires arranged in parallel, it is preferable that the bobbin is constituted of separators, the separators being arranged in parallel at predetermined intervals along a rotational axis of the bobbin, thereby forming respective annular grooves, such that the conductor wires are fit into the annular grooves one by one to be wound around the bobbin.

With this construction, it is possible to prevent a plurality of conductor wires wound around the bobbin from crossing each other, so that when performing winding on the reel with the bobbin attached to the flyer, each conductor wire can be smoothly drawn out of the bobbin.

Further, according to the present invention, in the method of winding a plurality of conductor wires arranged in parallel, it is preferable that the bobbin has a through-hole extending along the rotational axis of the bobbin, through-hole being through all the separators, an inner peripheral side end portion of the through-hole extending along a radial direction is provided to reach an inner periphery of the annular grooves, such that, when the conductor wires are wound around the bobbin, starting end portions of the conductor wires are retained by a clamp inserted into the through-hole to be pressed against the inner periphery of the annular grooves.

According to the above embodiment, the starting end portions of a plurality of conductor wires inserted into the annular grooves of the bobbin can be simultaneously pressed and retained with a single clamp, whereby it is possible to simplify the construction and realize satisfactory operability.

Further, it is preferable, in the method of winding a plurality of conductor wires arranged in parallel, that a plurality of bobbins are provided, and sets of the conductor wires are provided for each of the bobbins respectively, wherein, while drawing the conductor wires out of one of bobbins, the other bobbin is subjected to an operation of winding therearound.

With this arrangement, while winding is being performed on one bobbin attached to the flyer, the plurality of conductor wires can be wound around another bobbin, so that the winding cycle is not delayed by the bobbin winding operation, thus making it possible to expedite the winding cycle.

Further, it is desirable to provide two bobbins as mentioned above for a set of flyer and reel such that the bobbins are used alternately.

According to the above embodiment, two bobbins are used, and while winding is performed with one bobbin attached to the flyer, the plurality of conductor wires are wound around the other bobbin, thus making it possible to expedite the winding cycle with minimum equipment.

Further, in accordance with the present invention, there is provided a winding apparatus comprising a reel, a flyer which is configured to revolve around the reel, and a coil receiving jig arranged below the reel, in which, by rotating the flyer, a plurality of conductor wires are wound around the reel to form a coil, and the coil is dropped into the coil receiving jig, the winding apparatus comprising: a means for winding conductor wires, thereby the conductor wires being arranged in parallel around a bobbin; a means for moving the bobbin, thereby the bobbin being moved to a position for attachment to the flyer; and a means for attaching and/or detaching the bobbin to and/or from the flyer, wherein the flyer rotates in a state in which the bobbin is attached to the flyer, the bobbin being wound the conductor wires around, such that the conductor wires are drawn out of the bobbin to be wound around the reel.

In the winding apparatus according to the present invention, the means for winding conductor wires winds a plurality of conductor wires arranged in parallel around a bobbin. After the bobbin being moved to the position for attachment to the flyer by the means for moving the bobbin, the means for attaching and/or detaching the bobbin to and/or from the flyer attaches this bobbin to the flyer, and the flyer is rotated, thus making it possible to form a coil by winding a plurality of conductor wires around the reel while drawing them out of the bobbin. Thus, it is possible to perform a speedy winding cycle on parallel winding with a relatively simple construction.

According to the present invention, in the winding apparatus, it is preferable that the bobbin is constituted of separators, the separators being arranged in parallel at predetermined intervals along a rotational axis of the bobbin, thereby forming respective annular grooves, such that the conductor wires are fit into the annular grooves one by one to be wound around the bobbin.

As described above, with this arrangement, each conductor wire can be smoothly drawn out of the bobbin.

Further, according to the present invention, in the winding apparatus, it is preferable that the bobbin has a through-hole extending along the rotational axis of the bobbin, through-hole being through all the separators, an inner peripheral side end portion of the through-hole extending along a radial direction is provided to reach an inner periphery of the annular grooves, and the means for winding conductor wires has a clamp which is configured to be inserted into the through-hole and to serve to retain starting end portions of the conductor wires inserted into the annular grooves, such that starting end portions of the conductor wires are retained by the clamp inserted into the through-hole to be pressed against the inner periphery of the annular grooves.

As stated above, in this construction, the starting end portions of a plurality of conductor wires inserted into the annular grooves of the bobbin can be pressed and retained simultaneously by a single clamp, whereby it is possible to achieve simplification in construction and an improvement in operability.

Further, according to the present invention, it is preferable, in the winding apparatus, that the means for moving the bobbin has a plurality of support stands for supporting the bobbins, and each of the support stands moves between a first position where the means for winding conductor wires performs a winding operation, and a second position where attachment and/or detachment to and/or from the flyer are conducted, such that, while a set of the conductor wires are drawn out of one of the bobbins to be wound around the reel, other set of conductor wires are wound around the other bobbin by the means for winding conductor wires.

As stated above, in this construction, while winding is being performed with one bobbin attached to the flyer, the plurality of conductor wires can be wound around another bobbin, thus making it possible to expedite the winding cycle.

Further, according to the present invention, it is preferable, in the winding apparatus, that the means for moving the bobbin has a rotary table with two support stands for supporting the bobbins, and the two support stands move alternately by a rotational movement of the rotary table between the first position and the second position.

In this construction, while winding is performed with one bobbin attached to the flyer, the plurality of conductor wires can be wound around the other bobbin, thus making it possible to expedite the winding cycle with minimum equipment cost.

According to the present invention, the plurality of conductor wires are temporarily wound around the bobbin, and this bobbin is attached to the flyer of the winding device, and the flyer is rotated to wind the plurality of conductor wires around the reel while drawing them out of the bobbin, whereby it is possible to wind the plurality of conductor wires arranged in parallel without involving any twisting thereof. Further, since it is only necessary to add the step of temporarily winding the wires around the bobbin and attaching this bobbin to the flyer in order to perform the present invention, the winding apparatus for the method can be constructed with a relatively simple structure. Furthermore, the coils formed through winding around the reel by rotating the flyer can be successively dropped into the coil receiving jig during winding operation, and it is possible to simultaneously effect transfer of the coils from the reel to the coil receiving jig, thus making it possible to expedite the winding cycle.

DETAILED DESCRIPTION OF THE PREFERRED EMBODIMENT

Figure 1:
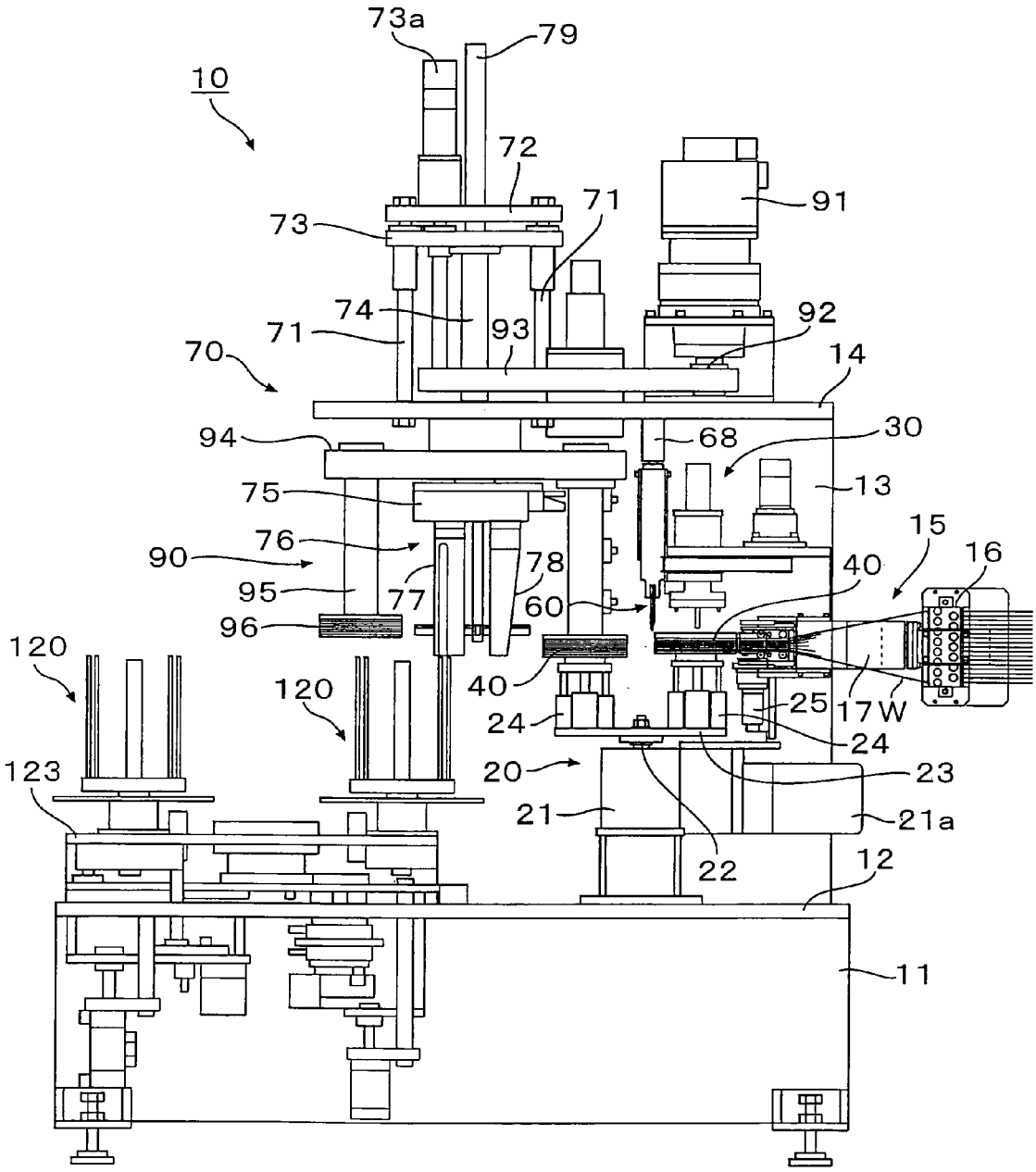
FIG. 1 is a front view of a winding apparatus according to an embodiment of the present invention.

In the following, a winding apparatus according to an embodiment of the present invention will be described with reference to the drawings.

A winding apparatus 10 is equipped with a base 11, a bobbin moving device 20 as for a means for moving a bobbin, the bobbin moving device 20 being installed on a table 12 of the base 11, a bobbin winding device 30 as for a means for winding conductor wires, the bobbin winding device 30 being for performing winding on a bobbin 40 supported by the bobbin moving device 20, a conductor wire supply device 15 for supplying conductor wires to the bobbin winding device 30, a winding device main body 70 adapted to receive the bobbin 40 around which conductor wires have been wound and to perform winding on a reel 76, and a coil receiving jig 120 for receiving a coil formed through winding by the winding device main body 70. On the table 12, there is provided an upright wall 13, and an upper table 14 is mounted to the upper end of the upright wall 13.

The bobbin moving device 20 installed on the table 12 has a support stand 21, and a rotary table 23 supported by a rotation shaft 22 protruding from the support stand 21. The rotary table 23 is adapted to be rotated by a motor 21*a*. At opposing positions on the rotary table 23, there are provided a pair of support portions 24 supporting the bobbins 40.

Figure 2:
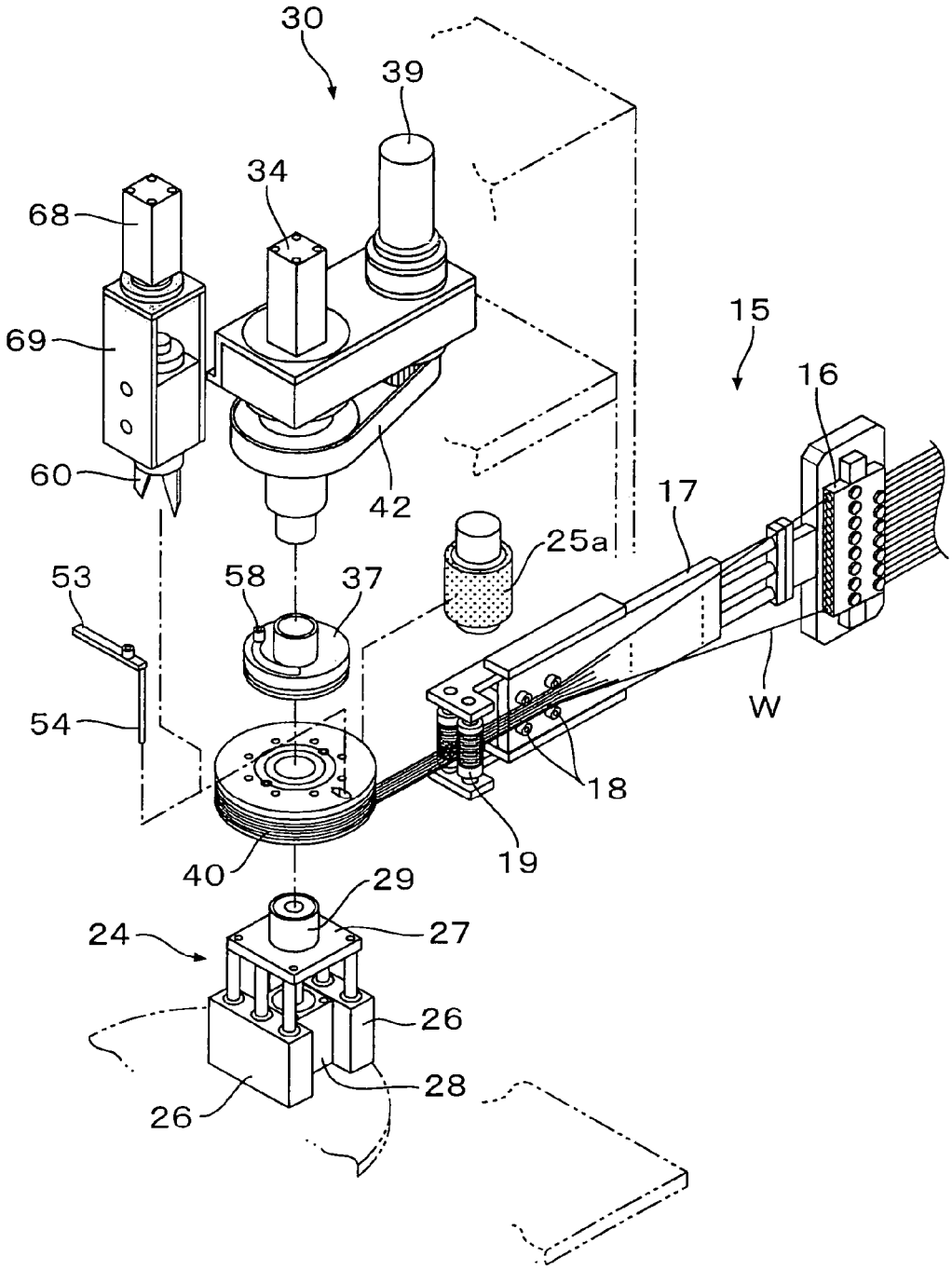
FIG. 2 is a schematic perspective view of a means for supplying conductor wires, a means for winding conductor wires, and a means for moving a bobbin of the winding apparatus.

Referring also to FIG. 2, each support portion 24 has a pair of raising/lowering cylinders 26, and a support plate 27 connected to operating rods of the raising/lowering cylinders 26. Further, an operating rod of a cylinder 28 arranged between the pair of raising/lowering cylinders 26 extends through the support plate 27, and a support roller 29 is attached to the upper end thereof. The support roller 29 is inserted into the interior of the bobbin 40, rotatably supporting the bobbin 40.

The conductor wire supply device 15 for supplying conductor wires to the bobbin 40 that is supported by the support portion 24 is arranged adjacent to the bobbin moving device 20. The conductor wire supply device 15 has a tension device 16, a pull-back cylinder 17, converging rollers 18, and a pair of guide rollers 19. A plurality of conductor wires W pass the tension device 16, and are aligned at a predetermined interval by the converging rollers 18, and further paid out substantially in parallel through the gap between the guide rollers 19. The pull-back cylinder 17 operates the tension device 16 to advance and retreat, making it possible to pull back the conductor wires W by a predetermined length.

Further, there is provided a rotational positioning roller 25*a*, which separably abuts the bobbin 40 installed on one support portion 24 of the rotary table 23, and which is arranged on the conductor wire supply device 15 side. A motor 25 shown in FIG. 1 rotates the rotational positioning roller 25*a*, so that the rotating position of the bobbin 40 can be adjusted.

Figure 3:
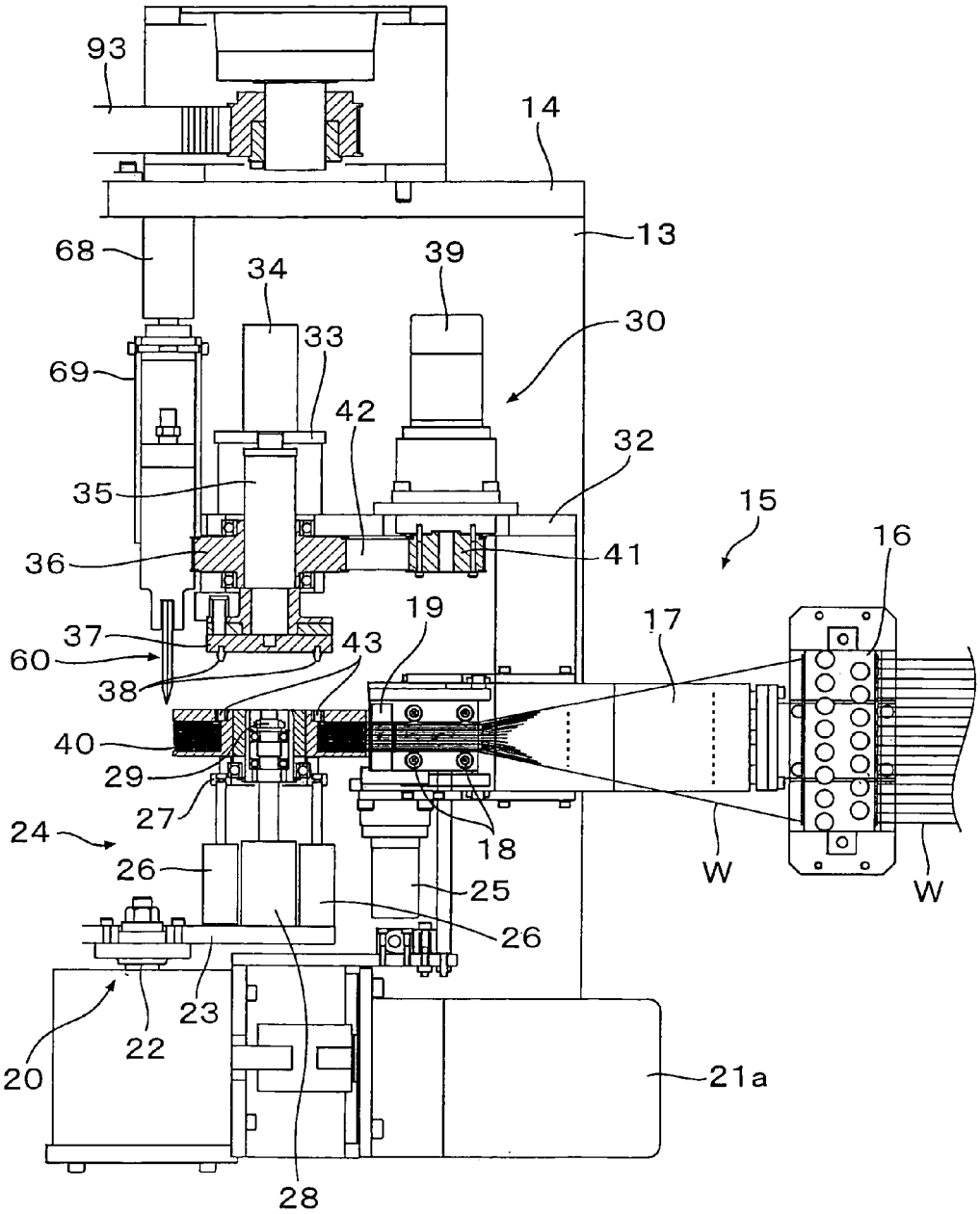
FIG. 3 is a front view of a means for supplying conductor wires, a means for winding conductor wires, and a means for moving a bobbin of the winding apparatus.

As shown in FIG. 3, above the support portion 24 arranged on a side of the conductor wire supply device 15, there is provided a bobbin winding device 30. The bobbin winding device 30 has a table 33 installed on a support plate 32, the support plate 32 being mounted horizontally at the intermediate height position of the upright wall 13, and an air cylinder 34 mounted on the table 33.

Rotatably attached to the operation shaft of the air cylinder 34 is a spline shaft 35, which extends downwards through the support plate 32. A driven pulley 36 is spline-engaged with the portion of the spline shaft 35 protruding below the support plate 32, and is rotatably supported. Further, a rotation plate 37 is mounted to the lower end of the spline shaft 35, and formed on the lower surface of the rotation plate 37 are protrusions 38 to be fit-engaged with holes 43 provided in the upper surface of the bobbin 40.

Further, a motor 39 is installed on the support plate 32 and beside the air cylinder 34, and the rotation shaft of the motor 39 extends downwards through the support plate 32, and a driving pulley 41 is attached to this rotation shaft. Between the driving pulley 41 and the driven pulley 36, there is stretched a timing belt 42; when the driving pulley 41 is rotated by the motor 39, the driven pulley 36 is rotated through the timing belt 42, so the spline shaft 35 spline-engaged with the driven pulley 36 rotates.

The bobbin 40 is installed at a predetermined rotating angle by the above-mentioned rotational positioning roller 25*a*; when, in this state, the air cylinder 34 operates, and the spline shaft descends, the protrusions 38 provided on the lower surface of the rotation plate 37 are inserted into the holes 43 of the bobbin 40, and the rotation plate 37 and the bobbin 40 are fit-engaged with each other.

In the state in which the rotation plate 37 and the bobbin are thus fit-engaged with each other, the rotation plate 37 rotates through operation of the motor 39, whereby the bobbin 40 rotates.

Figure 4:
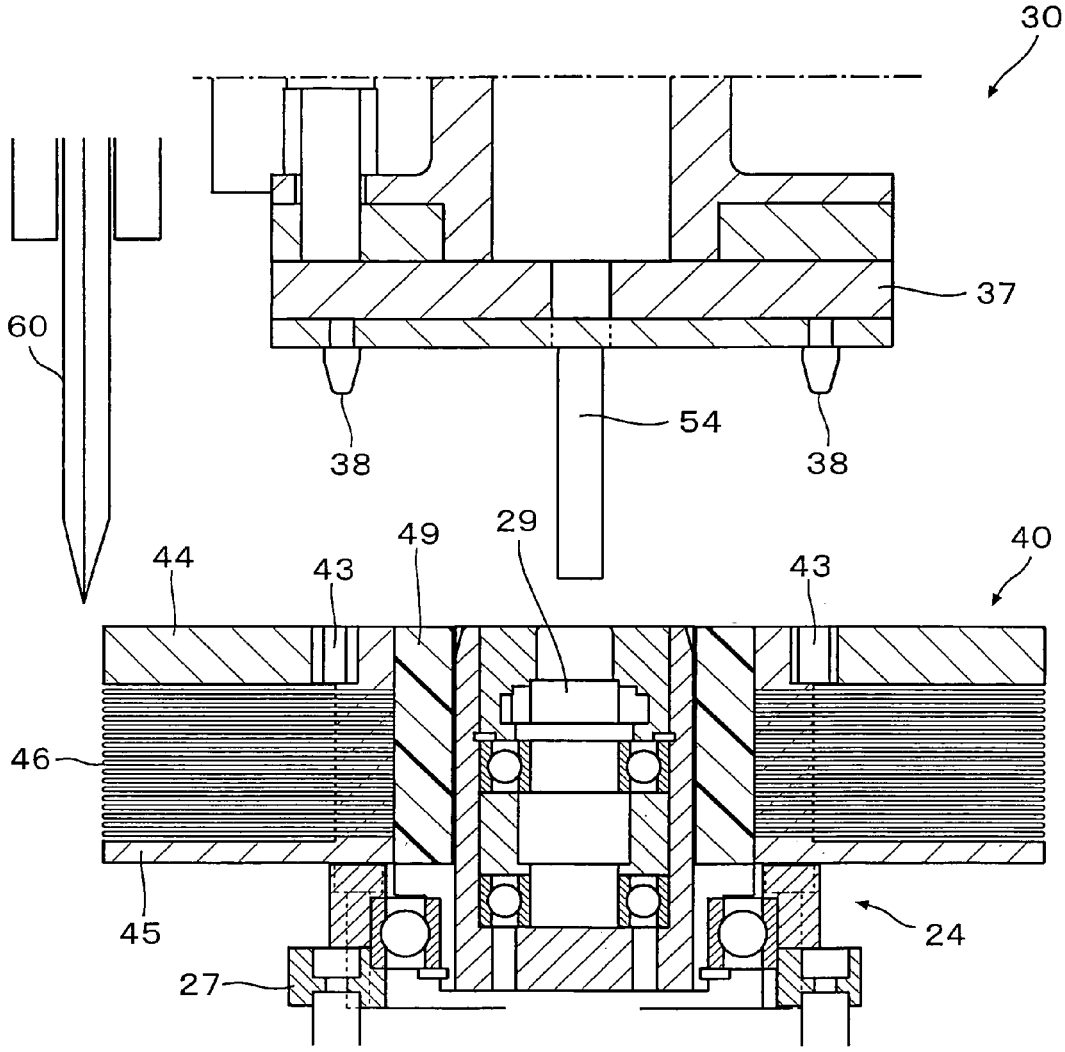
FIG. 4 is a partially enlarged sectional view of the means for winding conductor wires of the winding apparatus.
Figure 5:
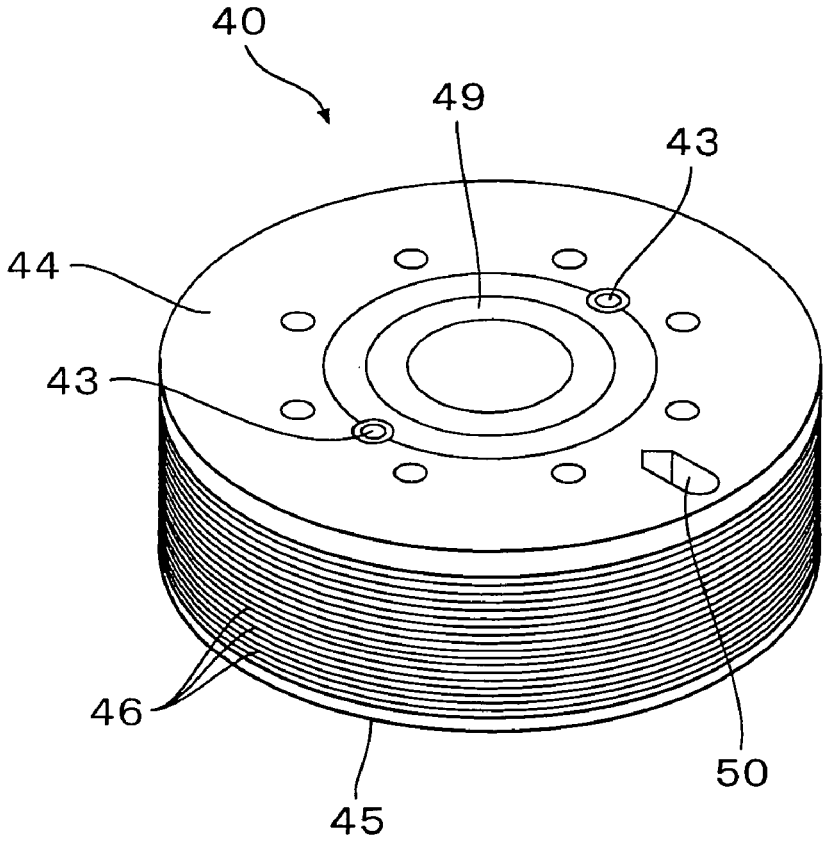
FIG. 5 is a perspective view of a bobbin used in the winding apparatus.
Figure 6:
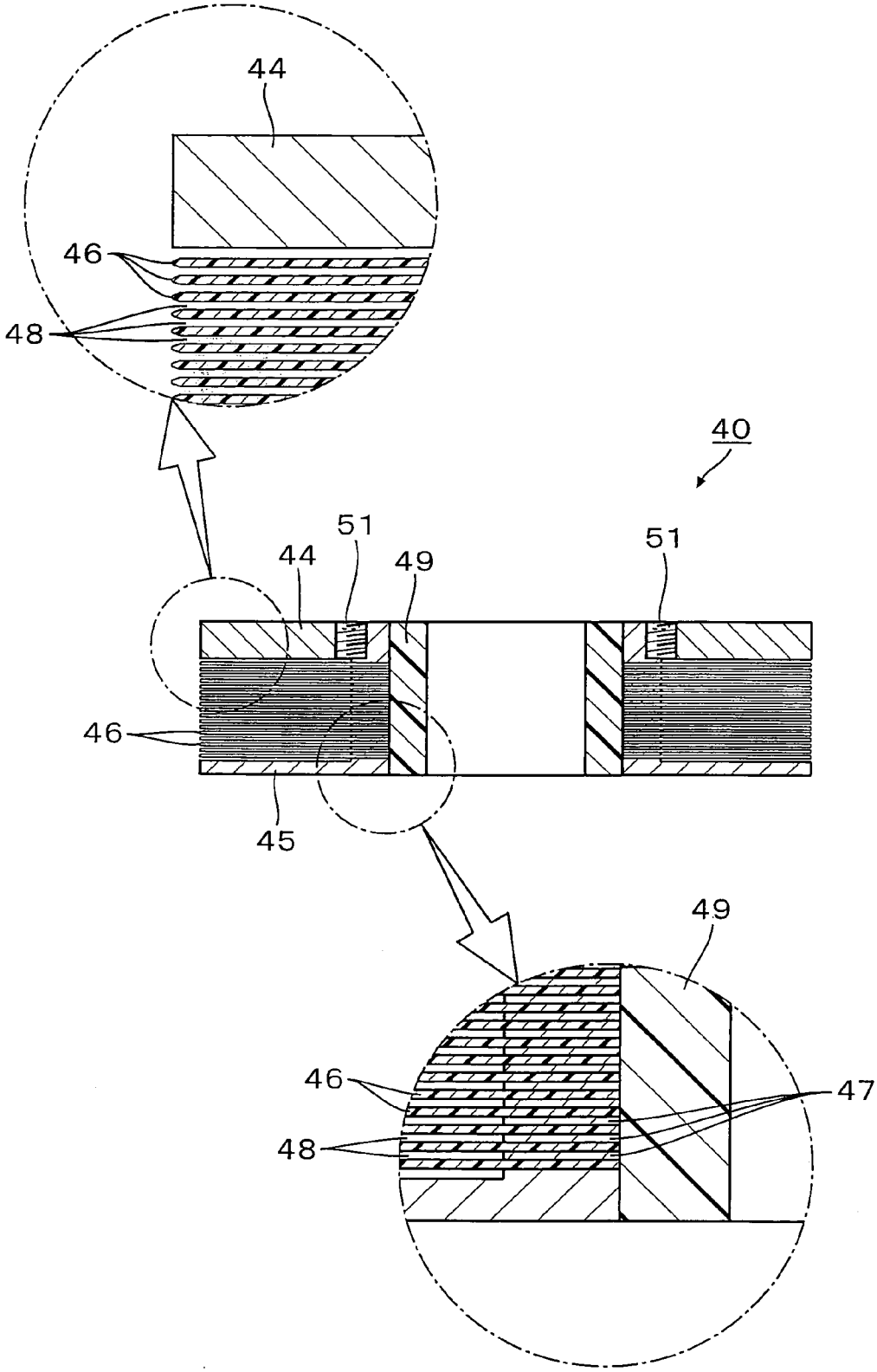
FIG. 6 is a sectional view of the bobbin.

As shown in FIGS. 4, 5, and 6, the bobbin 40 has a cylindrical body 49 into which the support roller 29 is inserted, a pair of end surface plates 44 and 45 attached to the outer periphery of the cylindrical body 49, and a plurality of separators 46 arranged at predetermined intervals between the pair of end surface plates 44 and 45.

The plurality of separators 46 are retained at predetermined intervals through the intermediation of spacers 47 arranged on the inner peripheral side thereof. The end surface plates 44 and 45, and the plurality of separators 46 are fixed integrally with each other by fastening bolts 51. And, between the end surface plates 44 and 45 and the separators 46, there are formed a plurality of annular grooves 48, into each of which a conductor wire W is inserted.

As stated above, a pair of holes 43 are formed in the upper surface of the bobbin 40. Further, there is formed a through-hole 50 which extends through the pair of end surface plates 44 and 45 and the plurality of separators 46 arranged therebewteen in the direction of the rotation shaft and extends radially until the inner peripheral end thereof reaches the inner periphery of the annular grooves 48.

Figure 7:
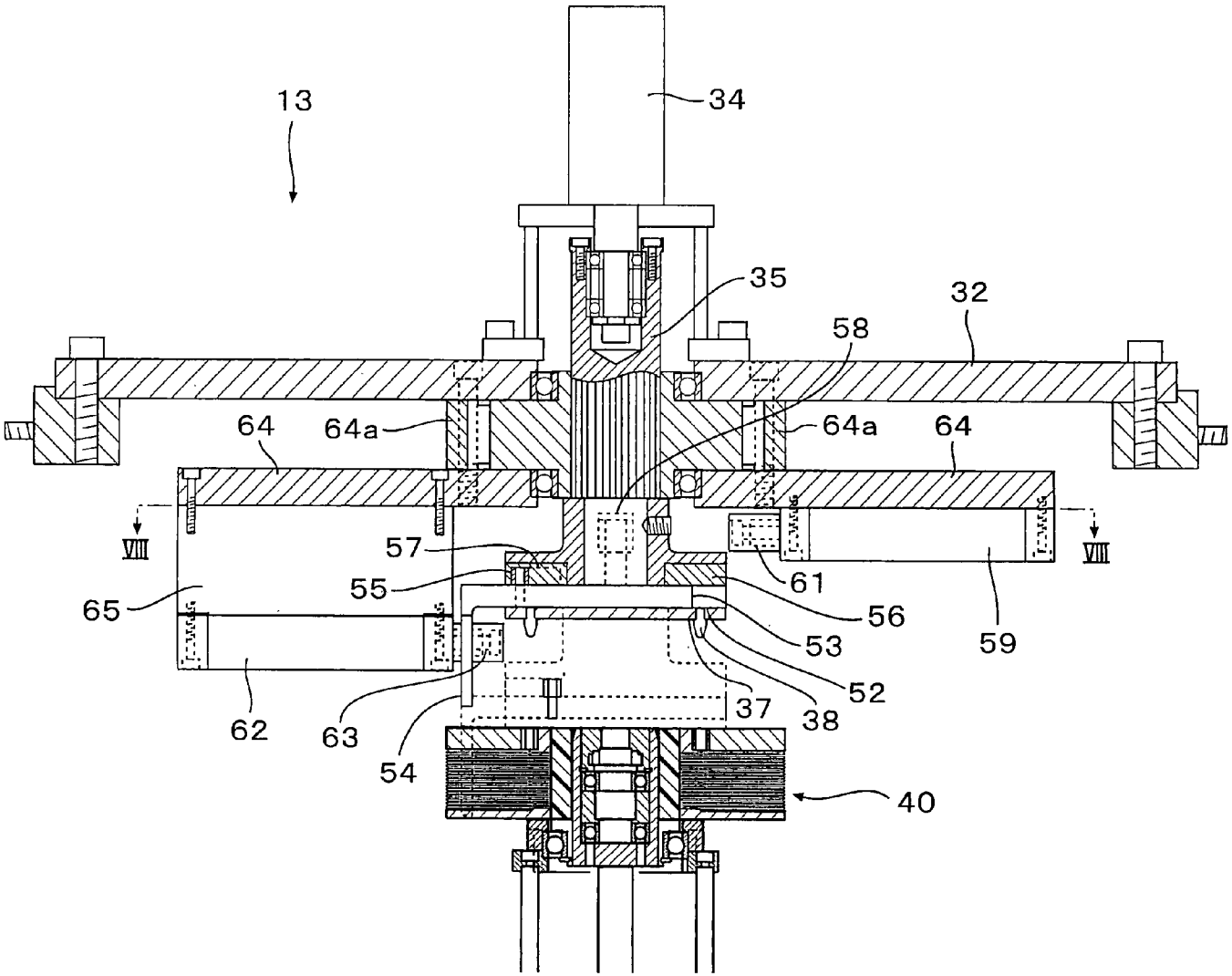
FIG. 7 is a sectional view showing a mechanism for clamping conductor wires to the bobbin in the winding apparatus.
Figure 8:
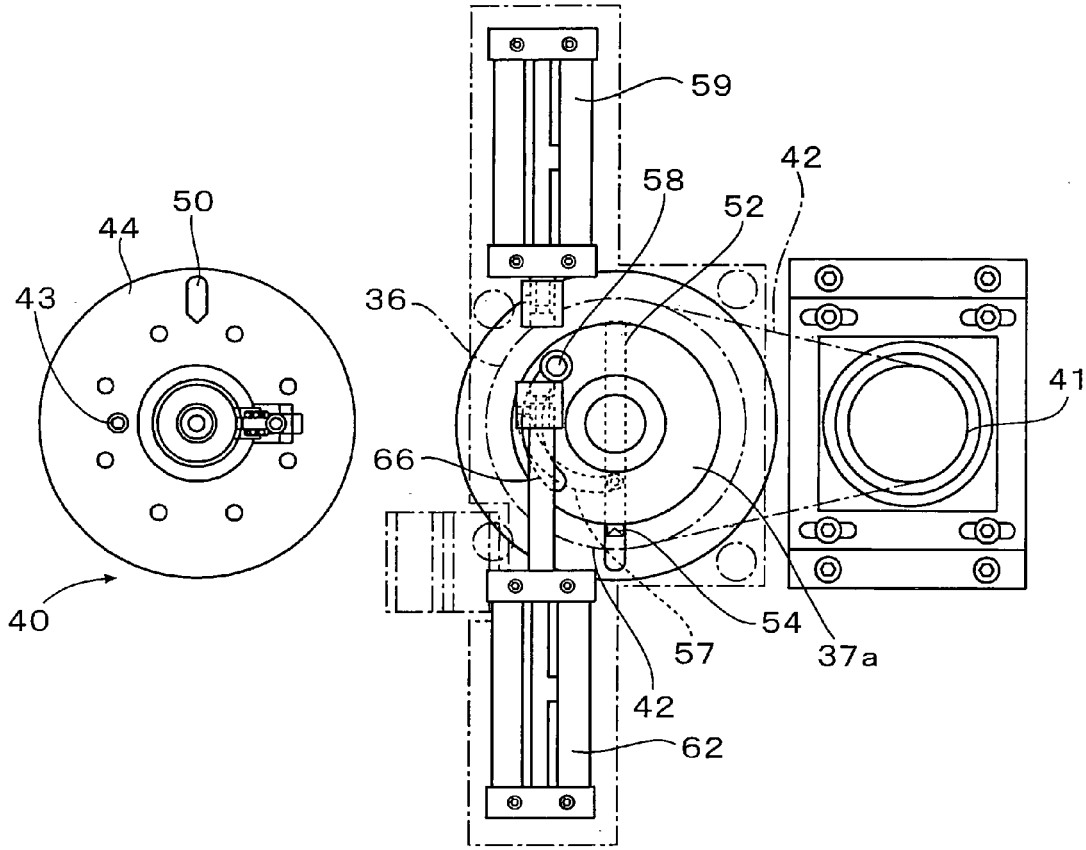
FIG. 8 is a sectional view taken in the direction indicated by the arrows VII-VIII shown in FIG. 7.

As shown in FIGS. 7 and 8, in the upper surface of the rotation plate 37, there is formed a guide groove 52 extending diametrically across the rotation plate 37. A lever 53 is slidably inserted into the guide groove 52, and, at one end of the lever 53 protruding from the guide groove 52, there is integrally provided a bar-like clamp 54 extending downwards. Further, at one position on the upper surface of the lever 53, there is mounted a cam follower 55. Further, above the guide groove 52 of the rotation plate 37, a cam plate 56 is rotatably attached. In the lower surface of the cam plate 56, there is formed a cam groove 57, into which the cam follower 55 of the lever 53 is inserted.

The cam groove 57 is formed as a spiral arc one end of which is situated on the inner peripheral side of the cam plate 56, and the other end of which is situated on the outer peripheral side of the cam plate 56. The upper surface of the cam plate 56 is covered with a cover 37*a* integral with the rotation plate 37; an arcuate slit 66 is formed in the cover 37*a*, and, through the slit 66, there extends a cam plate rotating protrusion 58 fixed to the cam plate 56.

Below the support plate 32, an auxiliary plate 64 is arranged through the intermediation of a spacer 64*a* so as to be substantially parallel with the support plate 32. The auxiliary plate 64 extends in the same direction as the lever 53 inserted into the guide groove 52 of the rotation plate 37, and has a pair of end portions extending so as to be opposed to the rotation plate 37. A clamp canceling air cylinder 59 is mounted to one end portion of the auxiliary plate 64, and the operating rod of the clamp canceling air cylinder 59 constitutes a pusher 61.

The pusher 61 is situated such that it can abut the cam plate rotating protrusion 58 at the position where the rotation plate 37 has been moved upwards by the air cylinder 34. That is, when, at that position, the pusher 61 is pushed out by the clamp canceling air cylinder 59, the pusher 61 abuts the cam plate rotating protrusion 58, and moves the cam plate rotating protrusion 58 along the slit 66. Then, the cam plate 56 connected to the cam plate rotating protrusion 58 rotates, and the lever 53 slides through the cam follower 55 inserted into the cam groove 57, and the clamp 54 moves to the outer peripheral side of the bobbin 40.

Further, a clamp fixing air cylinder 62 is mounted to the other end portion of the auxiliary plate 64 through the intermediation of a retaining plate 65. The operation rod of the clamp fixing air cylinder 62 constitutes a pusher 63. The pusher 63 is situated such that, when the rotation plate 37 abuts the upper surface of the bobbin 40 through operation of the air cylinder 34, it can abut the cam plate rotating protrusion 58. That is, when, at that position, the pusher 63 is pushed out through operation of the clamp fixing air cylinder 62, the cam plate rotating protrusion 58 is moved along the slit 66 in the direction opposite to the one mentioned above. As a result, the cam plate 56 connected to the cam plate rotating protrusion 58 rotates in the direction opposite to the one mentioned above, and the lever 53 slides in the direction opposite to the one mentioned above through the cam follower 55 inserted into the cam groove 57, with the clamp 54 moving to the inner peripheral side of the bobbin 40.

When the rotation plate 37 is lowered through operation of the air cylinder 34, and abuts the upper surface of the bobbin 40, the clamp 54 is inserted into the through-hole 50 of the bobbin 40. Thus, by moving the clamp 54 to the inner peripheral side of the bobbin 40 as stated above in this condition, the conductor wires W inserted into the plurality of annular grooves 48 defined by the plurality of separators 46 are pressed against the inner peripheral surfaces of the annular grooves 48 to be thereby clamped.

In this way, the clamp 54 can clamp and fix at one time a plurality of conductor wires W inserted into the annular grooves 48 of the bobbin 40. The clamp 54 rotates together with the rotation plate 37; at the time of this rotation, the pusher 63 of the clamp fixing air cylinder 62 retreats, and remains on standby at a position where it does not interfere with the cam plate rotating protrusion 58.

Referring to FIGS. 1, 2, and 3 again, a cutter 60 is arranged beside the bobbin winding device 30. The cutter 60 is mounted to a holder 69 attached to the lower surface of the upper table 14, the upper table 14 beeng mounted to the upper end of the upright wall 13 through the intermediation of an air cylinder 68. The cutter 60 performs opening/closing movements by a built-in air cylinder, and ascending/descending movements by the air cylinder 68.

The winding device main body 70 is arranged over the support portion 24 arranged at the circumferential position farther from the conductor wire supply device 15, as well as over the coil receiving jig 120. The winding device main body 70 has a pair of guide posts 71 arranged upright on the upper table 14, and a support plate 72 bridging the space between the upper ends of the guide posts 71. An ascent/descent plate 73 is mounted onto the pair of guide posts 71 so as to be capable of ascending and descending. The upper end of a support cylinder 74 is fixed to the center of the lower surface of the ascent/descent plate 73.

Figure 9:
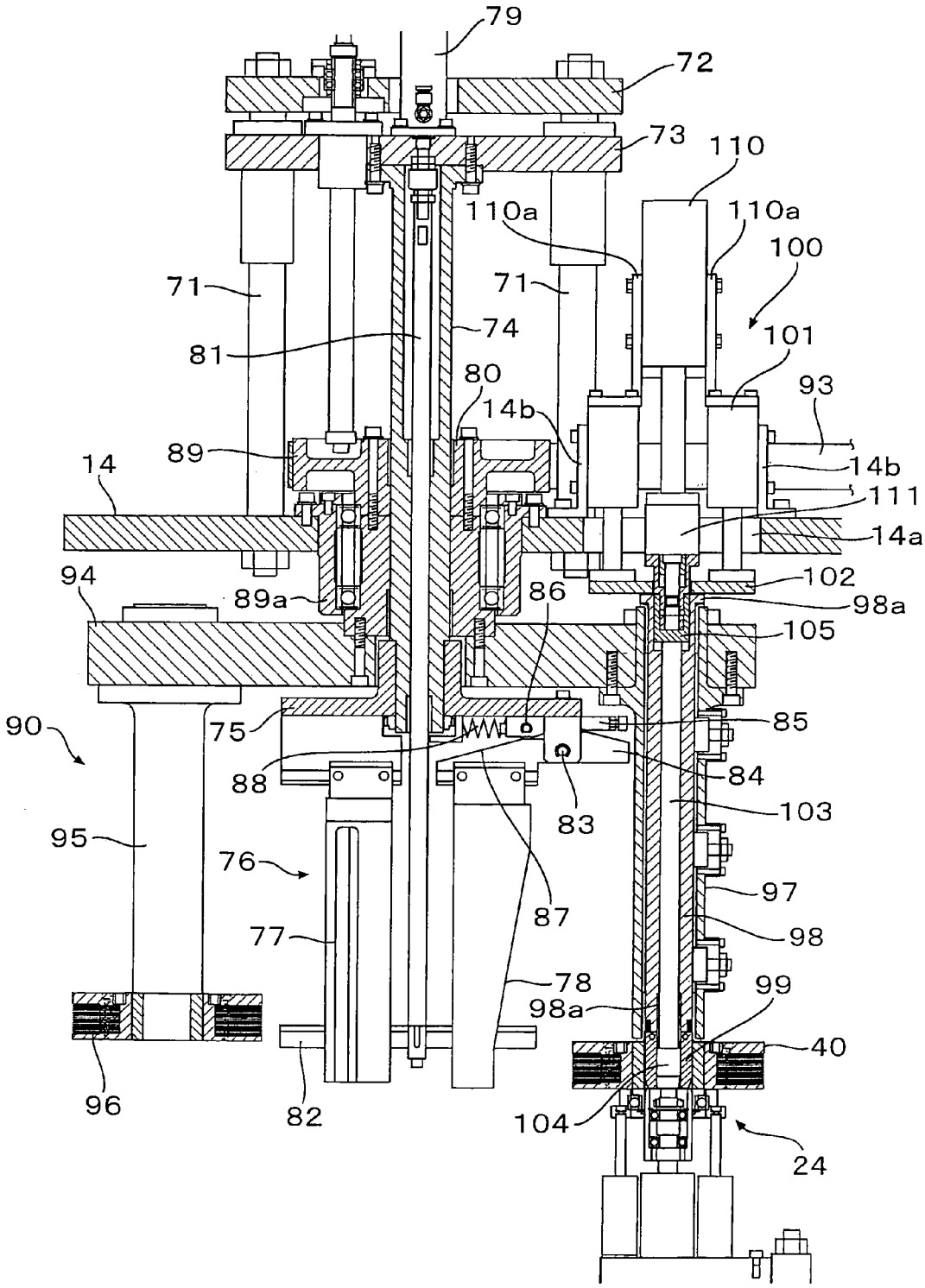
FIG. 9 is a sectional view of a reel and a flyer in the winding apparatus.

Referring also to FIG. 9, the support cylinder 74 extends through the upper table 14, and the reel 76 is mounted to the lower end thereof through the intermediation of a reel holder 75. The reel 76 is composed of a front reel 77 and a rear reel 78. Further, on the upper surface of the central portion of the ascent/descent plate 73, there is installed a brush-off plate air cylinder 79, and the operation rod thereof extends downwards through the ascent/descent plate 73, with a rod 81 being connected thereto.

The rod 81 is arranged inside the support cylinder 74, protruding from the lower end of the support cylinder 74, and is situated between the front reel 77 and the rear reel 78; mounted to the lower end thereof is a brush-off plate 82 extending horizontally in a cross-like fashion. The brush-off plate 82 serves to forcibly brush off a coil wound around the reel 76. The upper end portion of the rear reel 78 is fixed to a tilting plate 84 rotatably mounted to the reel holder 75 through the intermediation of an axle 83.

A slide shaft 85 is inserted between the tilting plate 84 and the reel holder 75, and a presser roller 86 is attached to an end portion of the slide shaft 85. On the other hand, a cam surface 87 is formed on the tilting plate 84, and the presser roller 86 is normally situated at the upper end of the cam surface 87 by the action of a spring 88, supporting the rear reel 78 to prevent it from tilting. However, when, upon completion of the winding of one coil, the slide shaft 85 is pushed in by a pusher (not shown), the presser roller 86 moves in the inclining direction of the cam surface 87, so that the rear reel 78 can tilt, making it easy for the coil wound around the reel 76 to drop.

A rotary cylinder 80 is rotatably attached through the intermediation of a bearing 89*a* attached to the upper table 14, to the outer periphery of the portion of the support cylinder 74, where the support cylinder 74 extending through the upper table 14. In the outer periphery of the upper end portion of the rotary cylinder 80, a driven pulley 89 is formed integrally therewith. The driven pulley 89 is connected to a driving pulley 92 of a flyer rotating motor 91 installed on the upper table 14 through a timing belt 93. Thus, when the driving pulley 92 rotates through operation of the flyer rotating motor 91, the driven pulley 89 is caused to rotate through the timing belt 93, causing the rotary cylinder 80 connected to the driven pulley 89 to rotate.

A rotary plate 94 is mounted to the lower end of the rotary cylinder 80, and a balance arm 95 is mounted to one circumferential end of the rotary plate 94 so as to protrude downwards. And, a balance weight 96 is mounted to the lower end of the balance arm 95. In this embodiment, the balance weight 96 is formed through mounting of a bobbin 40.

On the other hand, to the other end portion of the rotary plate 94 circumferentially opposite thereto, there is mounted a flyer arm 97 that likewise protrudes downwards. A bobbin 40 is detachably attached to the lower end of the flyer arm 97 in the manner described below.

Figure 10:
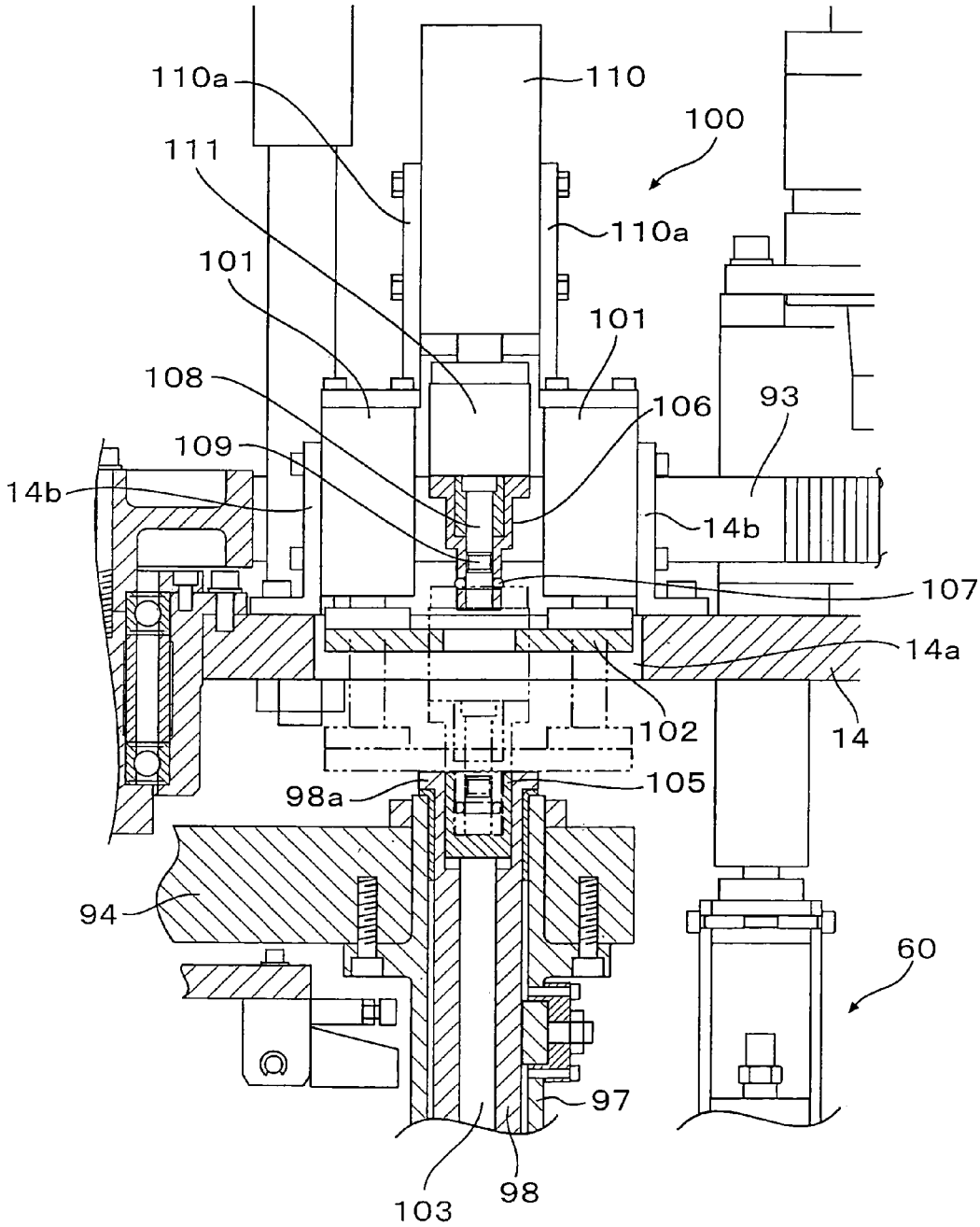
FIG. 10 is a partially enlarged sectional view of a driving portion of a bobbin attachment/detachment mechanism in the winding apparatus.
Figure 11:
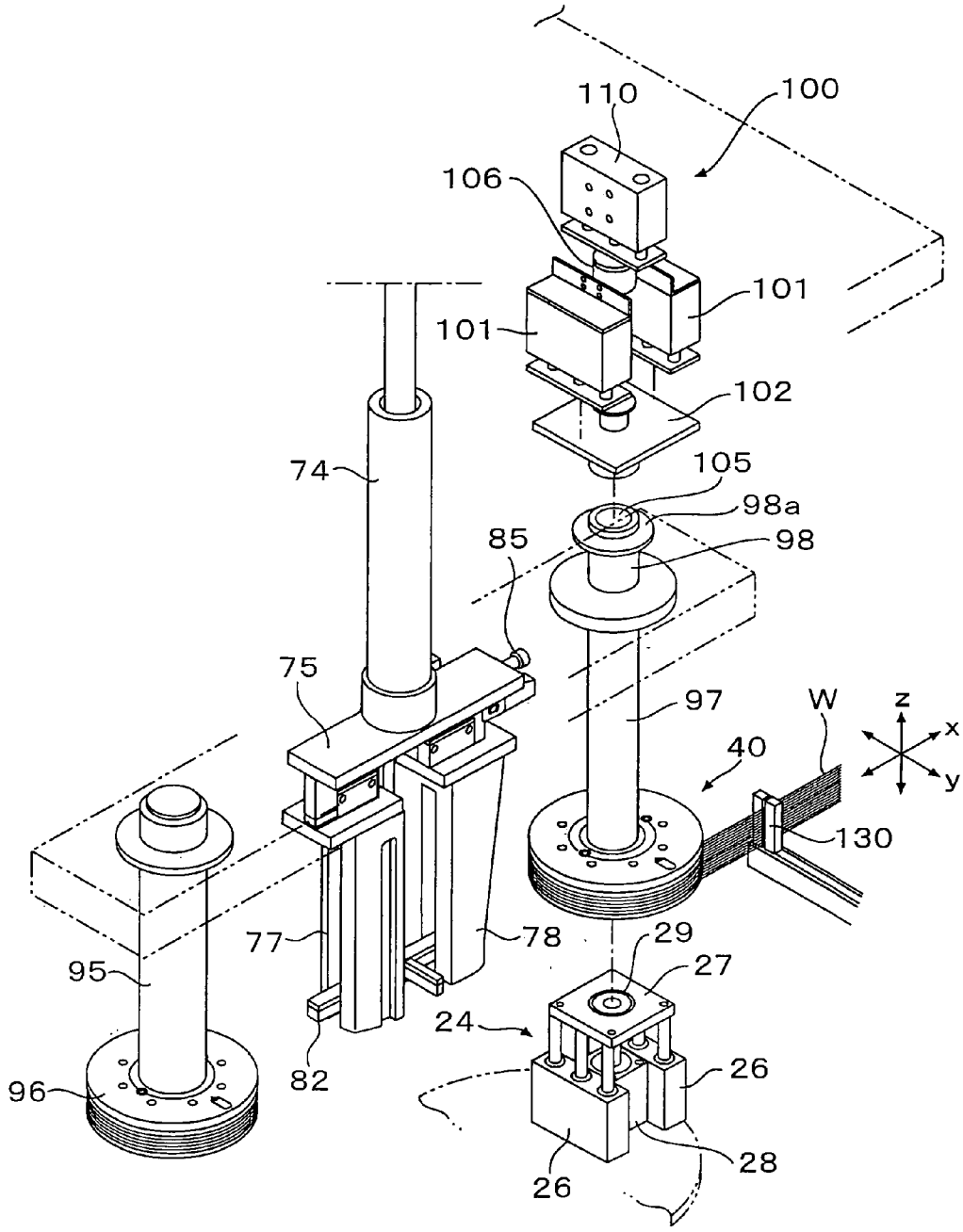
FIG. 11 is a perspective view of the reel and the flyer of the winding apparatus.

The bobbin 40 is detachably attached to the flyer arm 97 by a bobbin attaching/detaching device 100 as for a means for attaching and/or detaching the bobbin to and/or from the flyer. Referring also to FIGS. 10 and 11, a slide cylinder 98 is arranged in the inner periphery of the flyer arm 97. A flange 98*a* is formed at the upper end of the slide cylinder 98, and is engaged with the upper end portion of the flyer arm 97. In the inner periphery of the slide cylinder 98, there is arranged a central shaft 103. A socket 105 is mounted to the upper end of the central shaft 103. Further, as shown in FIG. 9, a plurality of flaps 99 are mounted to the lower end portion of the slide cylinder 98 so as to be capable of opening and closing. Further, the lower end portion of the central shaft 103 constitutes a head portion 104 inserted into the inner periphery of the flaps 99. In the inner periphery of the lower end portion of the slide cylinder 98, there is formed a large diameter portion 98*a*, into which the head portion 104 is inserted; when the head portion 104 ascends, it engages with the upper end portion of the large diameter portion 98*a*.

On the other hand, the flyer arm 97 allows rotational positioning by a sensor (not shown) when attaching or detaching the bobbin 40. That is, when attaching or detaching the bobbin 40, the flyer arm 97 is arranged above one support portion 24 of the bobbin moving device 20. An opening 14*a* is formed in the portion of the upper table 14 situated above the position where the attaching/detaching operation is conducted. Presser plate cylinders 101 are attached to the peripheral edge of the opening 14*a* through the intermediation of a bracket 14*b*. And, the operation rod of the presser plate cylinder 101 extends downwards through the opening 14*a*, and a presser plate 102 is mounted to the lower end thereof.

Further, an ascent/descent cylinder 110 is mounted between the pair of presser plate cylinders 101 through the intermediation of a bracket 110*a*. The operation rod of the ascent/descent cylinder 110 extends downwards, and an ascent/descent cylinder 111 is attached thereto. Further, a cylindrical plug 106 is integrally fixed to the lower surface of the attachment/detachment cylinder 111.

Holes are provided in the outer periphery of the lower portion of the plug 106, and balls 107 are arranged so as to be capable of partially protruding through the holes. Inserted into the inner periphery of the plug 106 is a ball pressing shaft 108 connected with the operation rod of the attachment/detachment cylinder 111. The ball pressing shaft 108 has an annular groove 109; when the annular groove 109 is arranged at the position of the balls 107, the balls 107 can sink in the inner periphery of the plug 106. On the other hand, when the ball pressing shaft 108 slides in the axial direction, and the annular groove 109 is deviated from the position of the balls 107, the balls 107 are pressed by the ball pressing shaft 108, and protrude on the outer peripheral side of the plug 106.

Further, the plug 106 can be caused to ascend and descend together with the ascent/descent cylinder 111 by the ascent/descent cylinder 110. In FIG. 11, numeral 130 indicates a clamp for the conductor wires W; the conductor wire clamp 130 can be moved in the X-Y-Z directions by a driving mechanism (not shown).

Figure 12:
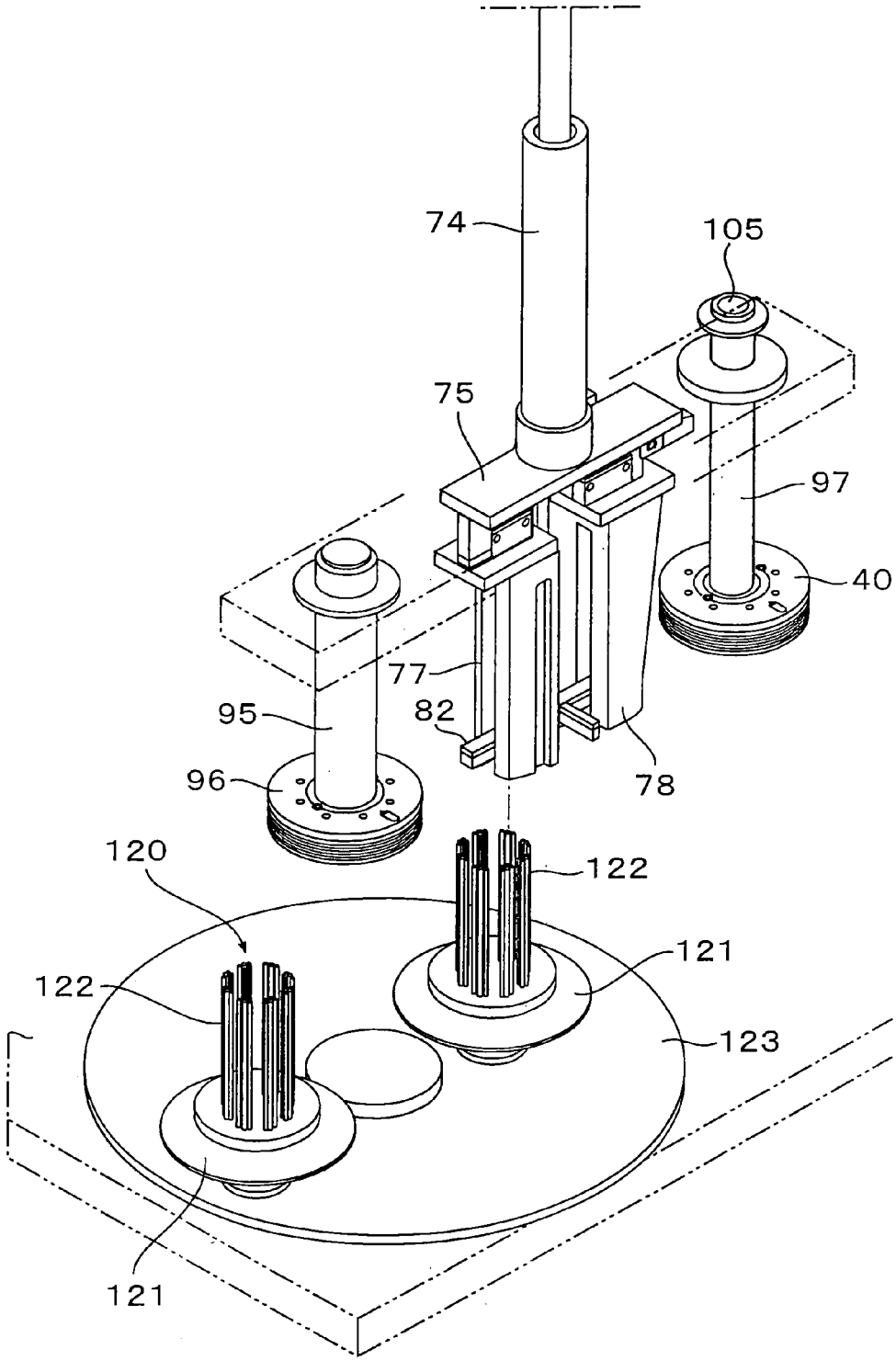
FIG. 12 is a perspective view of the reel, the flyer, and a coil receiving jig in the winding apparatus.

Referring to FIGS. 1 and 12, a turntable 123 is arranged on the table 12, and the coil receiving jigs 121 are arranged on the turntable 123 through the intermediation of receiving tables 121. Each coil receiving jig 120 has a plurality of guide bars 122 arranged as a whole in a ring, and the coil wound around the reel 76 is dropped into a predetermined gap of the guide bars 122.

Arranged on the turntable 123 are a plurality of (two, in this embodiment) coil receiving jigs 120 so as to be circumferentially opposed to each other; when one coil receiving jig 120 is situated below the reel 76, the other coil receiving jig 120 is removed together with the wound coil and replaced by another coil receiving jig 120 empty of coils. Each time the winding of one coil is completed, the coil receiving jig 120 rotates by a driving mechanism (not shown) such that a newly wound coil, the coil receiving jigs 120 re-positioning by a predetermined angle, is arranged in the predetermined gap of the guide bars 122.

Next, a winding method according to an embodiment of the present invention using the winding apparatus 10 will be described.

First, it is to be described how to perform the operation of winding conductor wires W around a bobbin 40 by the bobbin winding device 30.

Figure 22:
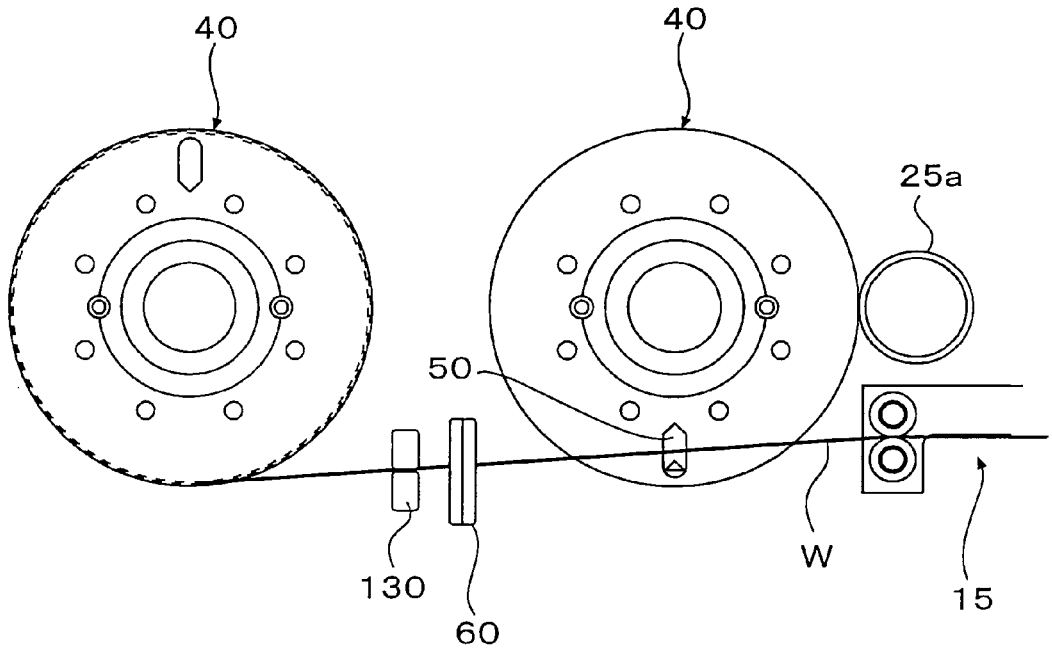
FIG. 22 is an explanatory plan view of the state of FIG. 21.

FIG. 22 shows a state in which a bobbin that has become empty after completion of winding operation is arranged below the bobbin winding device 30. In the preceding process, the bobbin 40 around which the conductor wires W are wound is situated below the flyer arm 97 of the winding apparatus main body 70 through rotational movement of the rotary table 23.

As a result, the conductor wires W are drawn out of the bobbin 40 and give a route leading to the conductor wire supply device 15. In the route, the conductor wire clamp 130 retains the conductor wires W. And, the cutter 60 is lowered onto the portion of the conductor wires aside from the conductor wire clamp 130 on the side for the conductor wire supply device 15, cutting the conductor wires W. At this time, the empty bobbin 40 is situated by the rotational positioning roller 25*a* such that the conductor wires W pass the portion corresponding to the through-hole 50.

Figure 24:
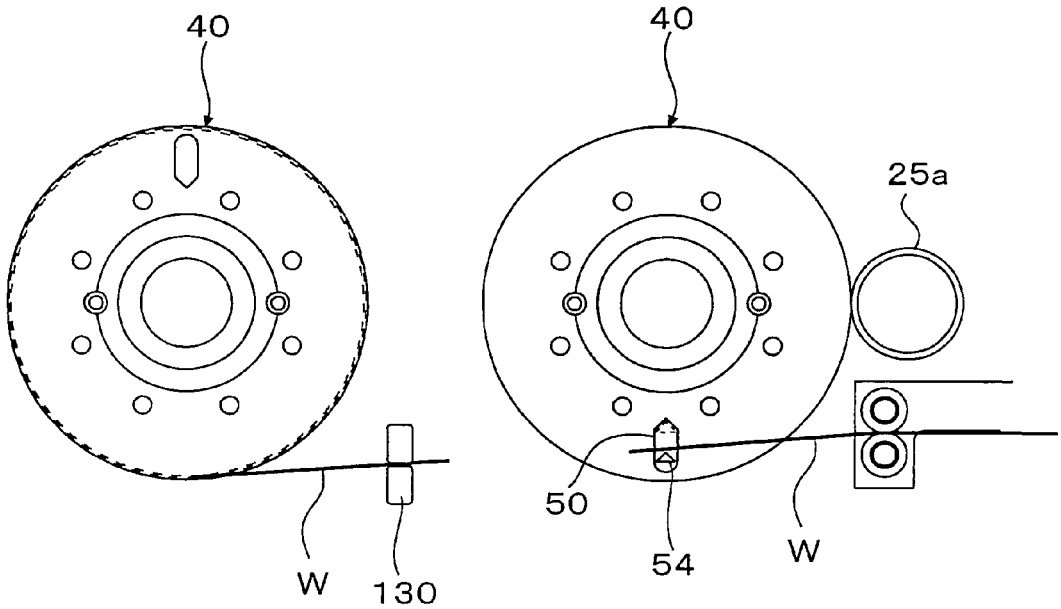
FIG. 24 is an explanatory plan view of the state of FIG. 23.

In this state, after the conductor wires Ware cut by the cutter 60, the conductor wires W are drawn by the pull-back cylinder 17 of the conductor wire supply device 15, and, as shown in FIG. 24, the end portions of the cut conductor wires are arranged at a position past the through-hole 50. Thus, with the end portions of a plurality of conductor wires W being inserted into the annular grooves 48 of the bobbin 40, the air cylinder 34 shown in FIG. 7 is operated, and the rotation plate 37 descends. Then, the clamp 54 provided on the rotation plate 37 is inserted into the through-hole 50, and the protrusions 38 of the rotation plate 37 shown in FIG. 4 are inserted into the holes 43 of the bobbin 40.

Then, the clamp fixing air cylinder 62 of FIG. 7 is operated, and the pusher 63 is pushed out, with the result that the cam plate rotating protrusion 58 is pushed to rotate the cam plate 56, and the lever 53 slides through the cam groove 57 and the cam follower 55, the clamp 54 moving to the inner peripheral side of the through-hole 50. As a result, the clamp 54 simultaneously clamps the end portions of the conductor wires W inserted into the plurality of annular grooves 48 of the bobbin 40.

After sliding the lever 53, the pusher 63 returns to the original position, and does not interfere with the rotational movement of the rotation plate 37. In this state, the motor 39 of the bobbin winding device is operated (see FIG. 3), and the rotation plate 37 is rotated through the driving pulley 41, the timing belt 42, and the driven pulley 36, and, at the same time, the bobbin 40 rotates, with a plurality of conductor wires W entering the corresponding annular grooves 48 of the bobbin 40 to be wound around the same.

When the operation of winding the conductor wires around the bobbin 40 is thus completed, the motor 39 stops, and the rotation plate 37 stops. Then, the air cylinder 34 through the spline shaft 35 raises the rotation plate 37, and the clamp 54 is pulled out from the through-hole 50 and separated from the bobbin 40.

The conductor wires W are inserted into the corresponding annular grooves 48 partitioned by the separators 46 before being wound, so that they do not cross each other, and when they are to be drawn out in the winding step described below, they can be drawn out smoothly.

During the operation of winding the conductor wires W around the target bobbin 40 by the bobbin winding device 30, the other bobbin 40 is attached to the flyer arm 97 of the winding device main body 70, and the winding operation is conducted. Then, when the bobbin 40 used for the winding operation has become empty upon completion of the winding operation, the empty bobbin is transferred from the flyer arm 97 to the support portion 24, and the rotary table 23 rotates to effect replacement with the bobbin 40 around which the conductor wires W have been wound.

Next, it is to be described how to perform the winding operation by the winding device main body 70.

First, the operation of detaching the bobbin 40 that has become empty upon completion of winding operation is to be described.

Figure 13:
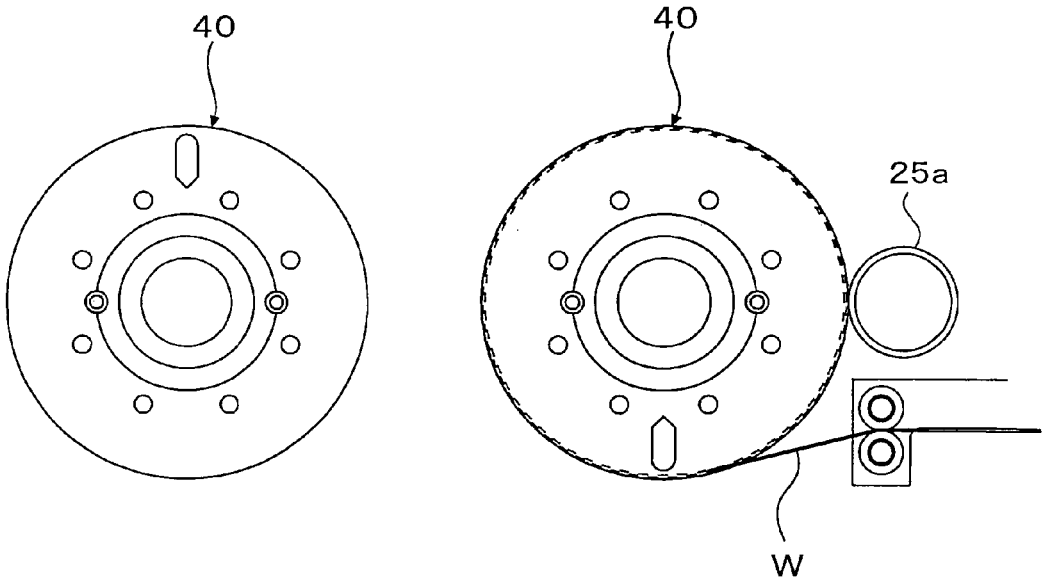
FIG. 13 is a plan view of a bobbin which has become empty upon completion of winding operation to the reel and a bobbin on which winding operation to the bobbin has been completed in the winding apparatus.

In FIG. 13, the bobbin 40 mounted onto the flyer arm 97 and having become empty upon completion of winding operation is shown on the left-hand side, and the bobbin 40 around which the conductor wires W have been wound by the bobbin winding device 30 is shown on the right-hand side.

Figure 14:
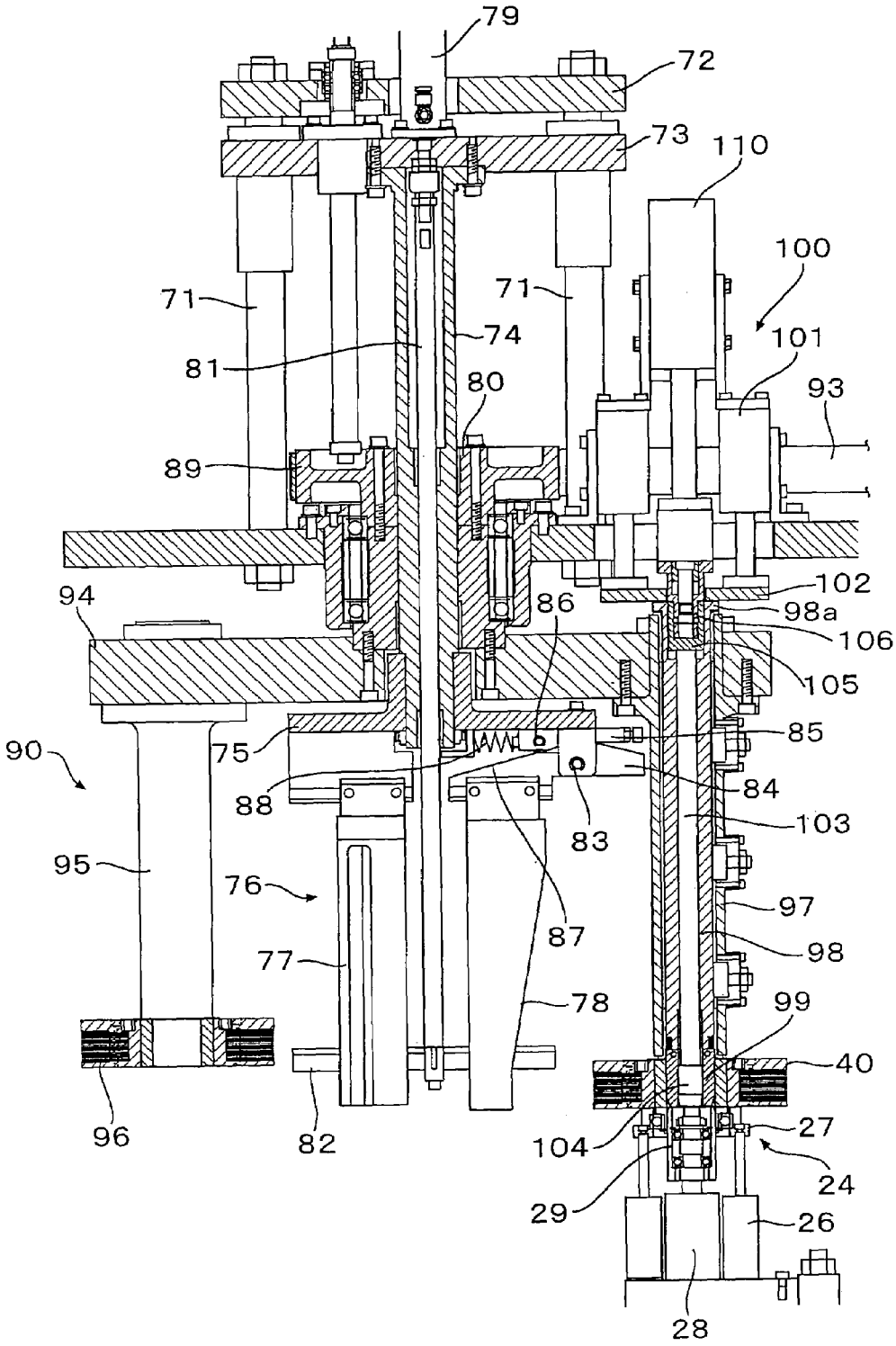
FIG. 14 is an explanatory view of a state in which a plug of an ascent/descent cylinder has been inserted for connection into a socket fixed to the upper end of a central shaft of a flyer arm upon completion of winding operation.

As shown in FIG. 14, in this state, the ascent/descent cylinders 26 of the support portion 24 operate, and the support plate 27 ascends to abut the lower surface of the bobbin 40. On the other hand, the presser plate cylinders 101 of the parallel winding device 100 operate, and the presser plate 102 descends to abut the flange 98*a* of the slide cylinder 98.

Referring also to FIG. 10, further, the ascent/descent cylinder 110 operates, and the plug 106 descends, so it is inserted into the socket 105 attached to the upper end of the central shaft 103. In this state, the attachment/detachment cylinder 111 operates, and the ball pressing shaft 108 descends, causing the balls 107 to partially protrude from the grooves in the outer periphery of the plug 106 to thereby connect the plug 106 with the socket 105.

Figure 15:
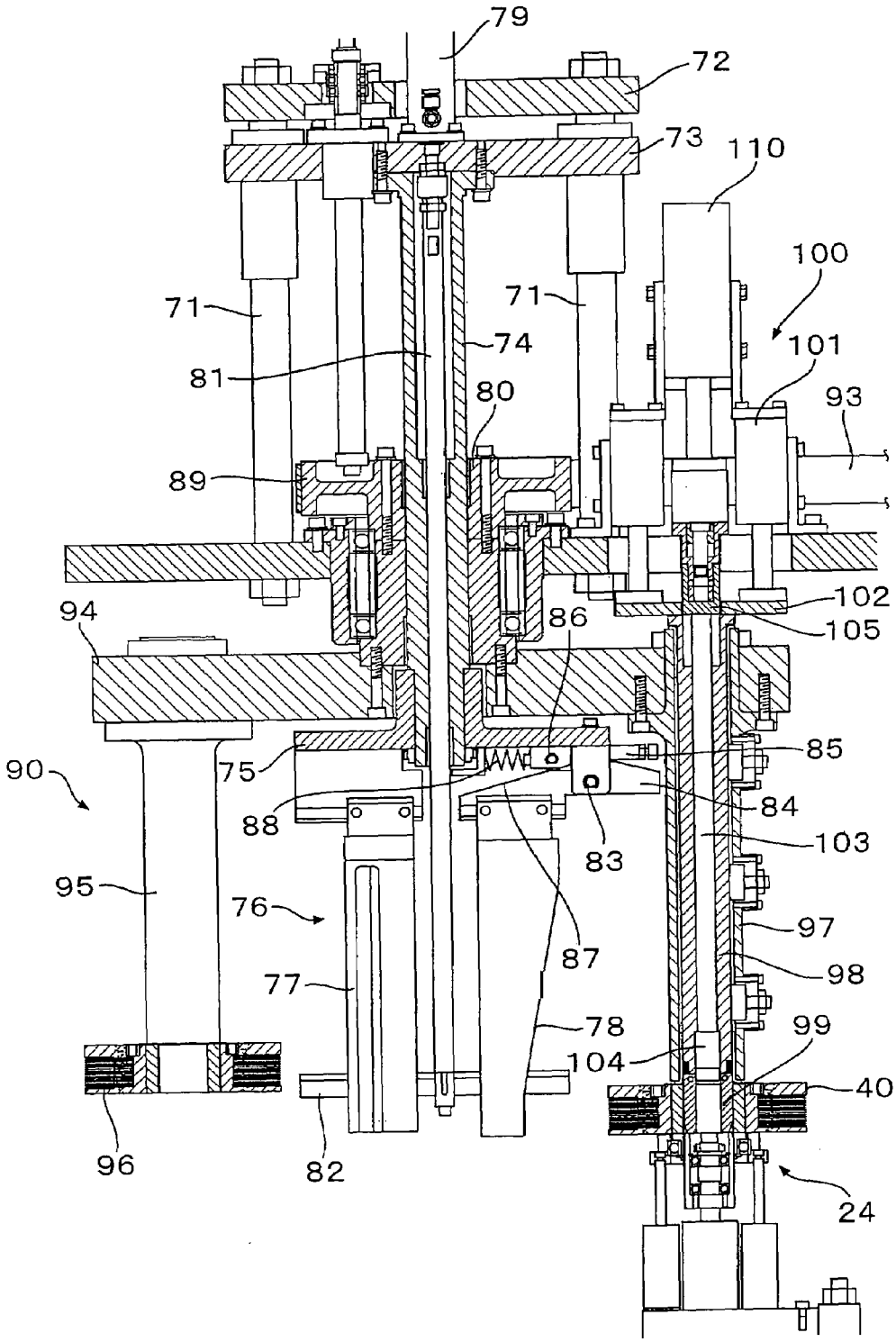
FIG. 15 is an explanatory view of a state in which the central shaft has been raised by the ascent/descent cylinder.
Figure 16:
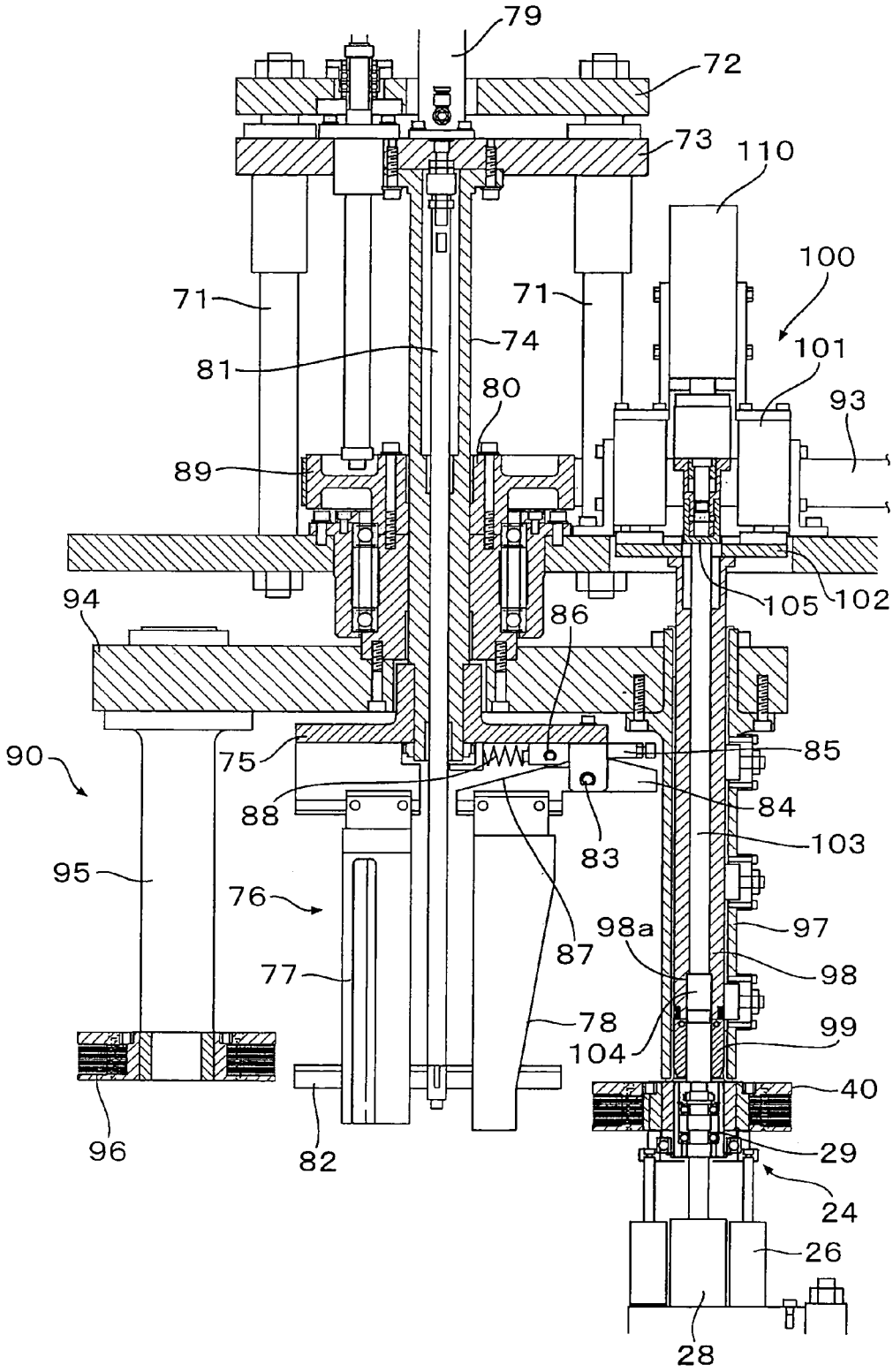
FIG. 16 is an explanatory view of a state in which a presser plate has been raised by a presser plate cylinder and in which the central shaft has been further raised by the ascent/descent cylinder to detach the bobbin.

Next, as shown in FIG. 15, the ascent/descent cylinder 110 operates to raise the central shaft 103, and the head portion 104 at the lower end thereof is pulled out of the inner periphery of the flaps 99. As a result, the flaps 99 become capable of tilting inwards, so the engagement between the bobbin 40 and the flyer arm 97 is canceled. Further, as shown in FIG. 16, the presser plate 102 is raised through operation of the presser plate cylinder 101, and the central shaft 103 is further raised through operation of the ascent/descent cylinder 110.

Figure 17:
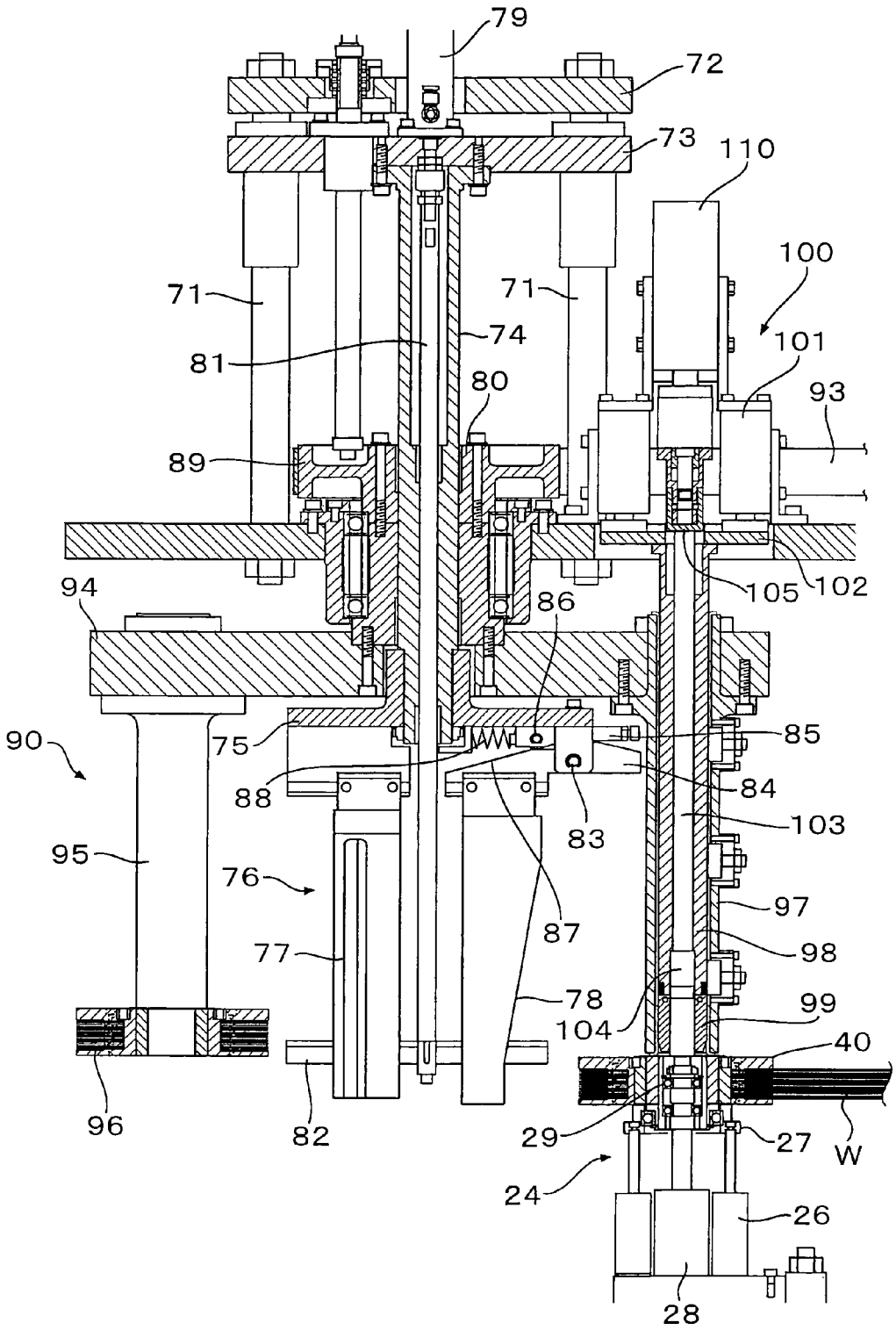
FIG. 17 is an explanatory view of a state in which a bobbin, which has undergone winding, is arranged below the flyer arm.
Figure 18:
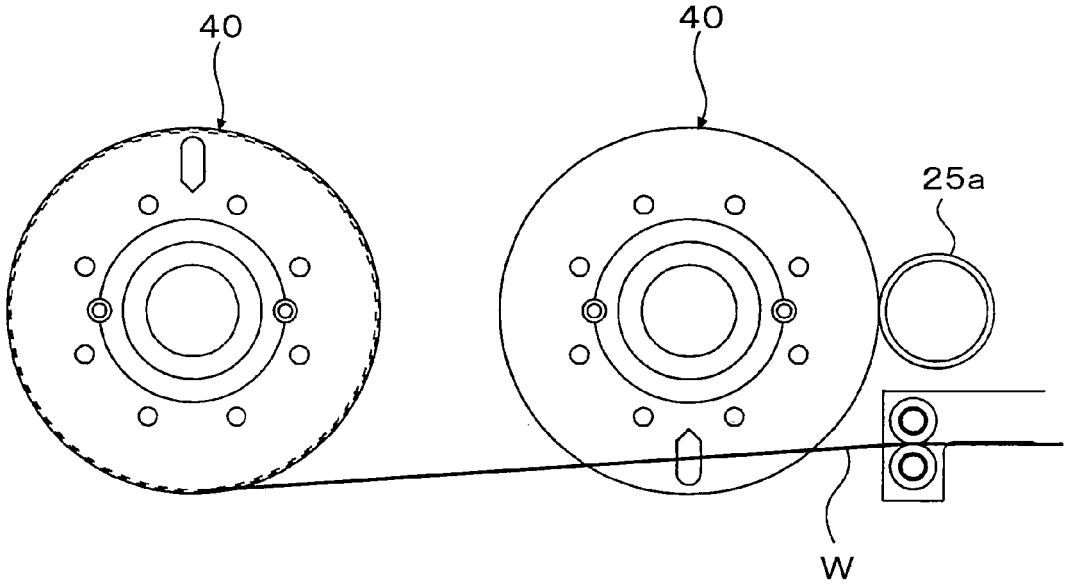
FIG. 18 is an explanatory plan view of the state of FIG. 17.

The head portion 104 of the central shaft 103 is engaged with the upper end of the large diameter portion 98*b* of the slide cylinder 98, so that the slide cylinder 98 is also raised, and the flaps 99 are completely pulled out of the bobbin 40. At the same time, the cylinder 28 of the support portion 24 operates, and the support roller 29 is inserted into the inner periphery of the bobbin 40, supporting the bobbin 40 on the support portion 24. In this state, the rotary table 23 of the bobbin moving device 20 rotates, and, as shown in FIG. 17, a new bobbin 40 around which conductor wires W have been wound is arranged below the flyer arm 97. FIG. 18 is an explanatory plan view of this state.

In the state as shown in FIG. 17, the cylinder 28 of the support portion 24 operates, and the support roller 29 is pulled out of the bobbin 40, and, at the same time, the ascent/descent cylinder 110 operates to lower the central shaft 103, inserting the flaps 99 into the inner periphery of the bobbin 40. Further, the presser plate cylinders 101 operate to lower the presser plate 102, and the central shaft 103 is further lowered through operation of the ascent/descent cylinder 110; the head portion 104 at the lower end thereof is inserted into the inner periphery of the flaps 99, and the bobbin 40 is attached to the lower end of the slide cylinder 98 of the flyer arm 97.

Figure 19:
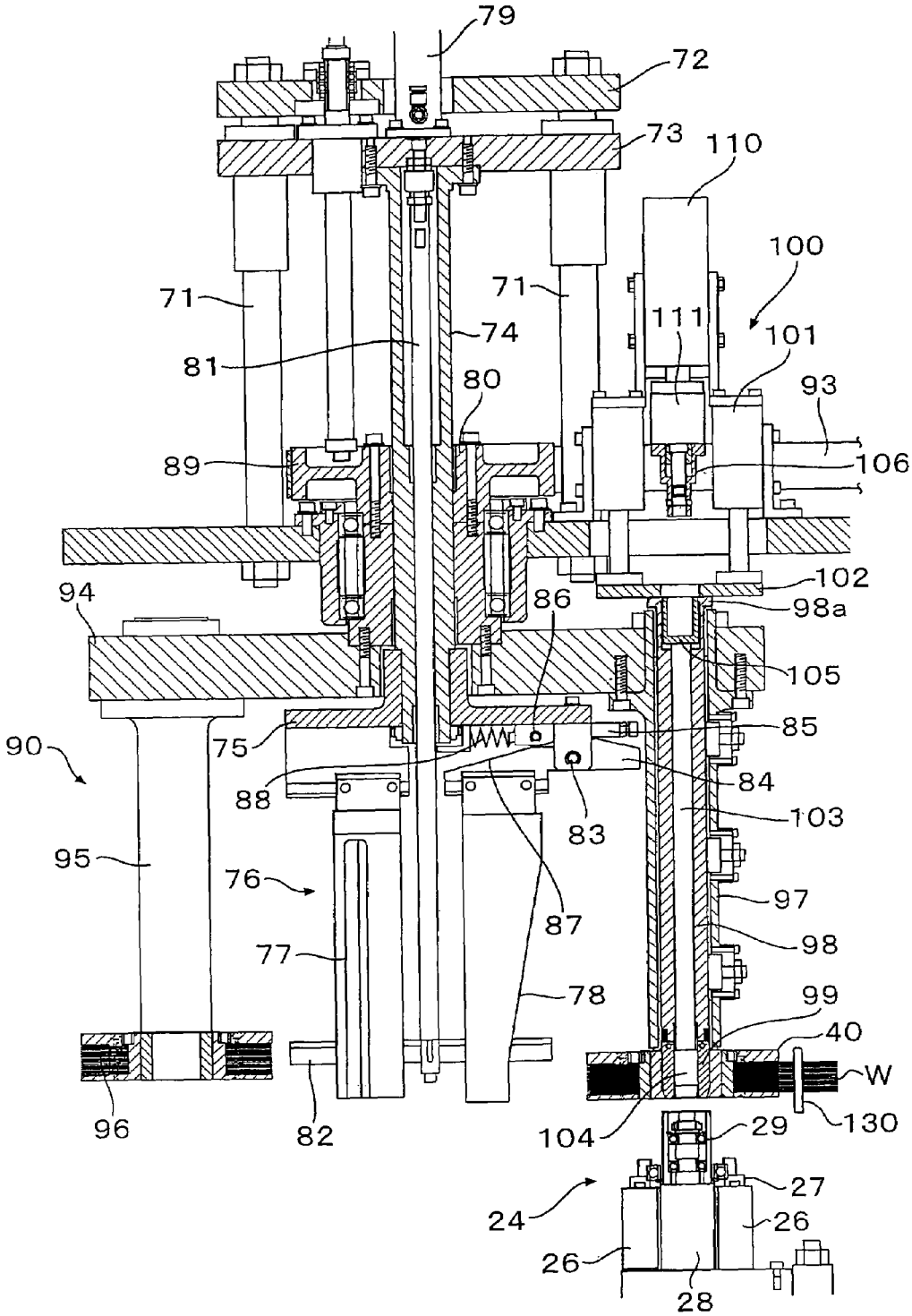
FIG. 19 is an explanatory view of a state in which a bobbin, which has undergone winding, is connected to the flyer arm, with conductor wires being retained by a movable clamp.
Figure 20:
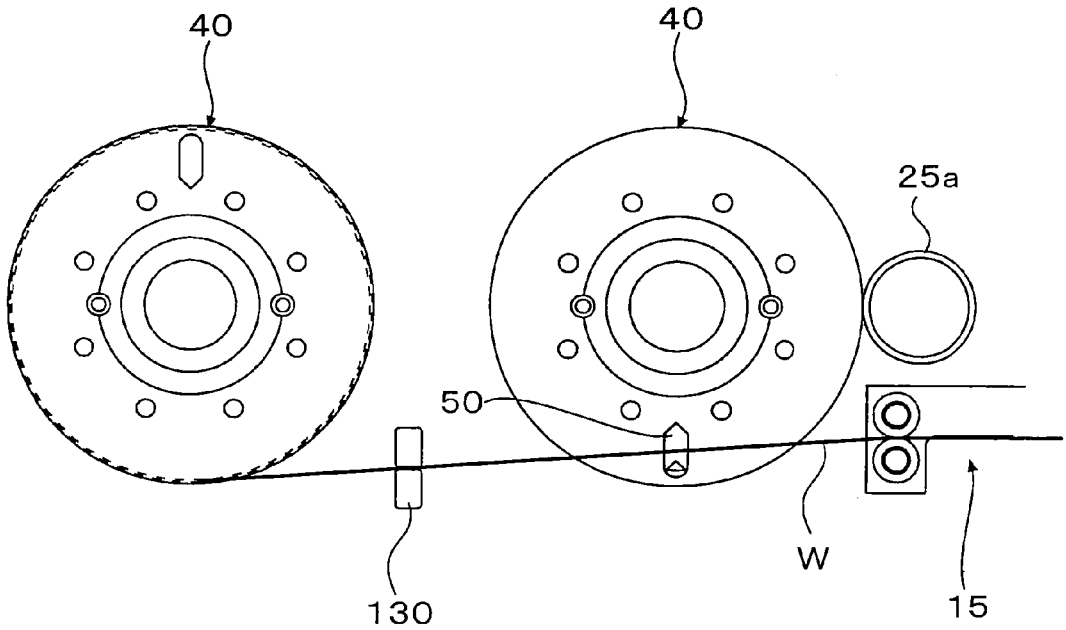
FIG. 20 is an explanatory plan view of the state of FIG. 19.

As shown in FIG. 19, in this state, the ascent/descent cylinders 26 of the support portion 24 operate, and the support plate 27 descends so as to be separated from the bobbin 40. Further, the attachment/detachment cylinder 111 shown in FIG. 10 operates, and the ball pressing shaft 108 slides; the annular groove 109 is positioned in correspondence with the balls 107, and the balls 107 retract into the inner periphery of the plug 106, canceling the engagement between the plug 106 and the socket 105. FIG. 20 is an explanatory plan view of this state.

In this state, the ascent/descent cylinder 110 operates, and the plug 106 is raised and pulled out of the socket 105. During this operation, the presser plate cylinders 101 hold the presser plate 102 in contact with the flange 98*a* of the slide cylinder 98, allowing the plug 106 to be pulled out reliably. After the plug 106 has been thus pulled out, the presser plate cylinder 101 operate, and the presser plate 102 also ascends.

As described with reference to the bobbin winding operation, the route for the conductor wires W extending between the bobbin 40 and the conductor wire supply device 15 is set such that they pass through the through-hole 50 of the bobbin 40. Then, the conductor wire clamp 130 clamps the conductor wires W.

Figure 21:
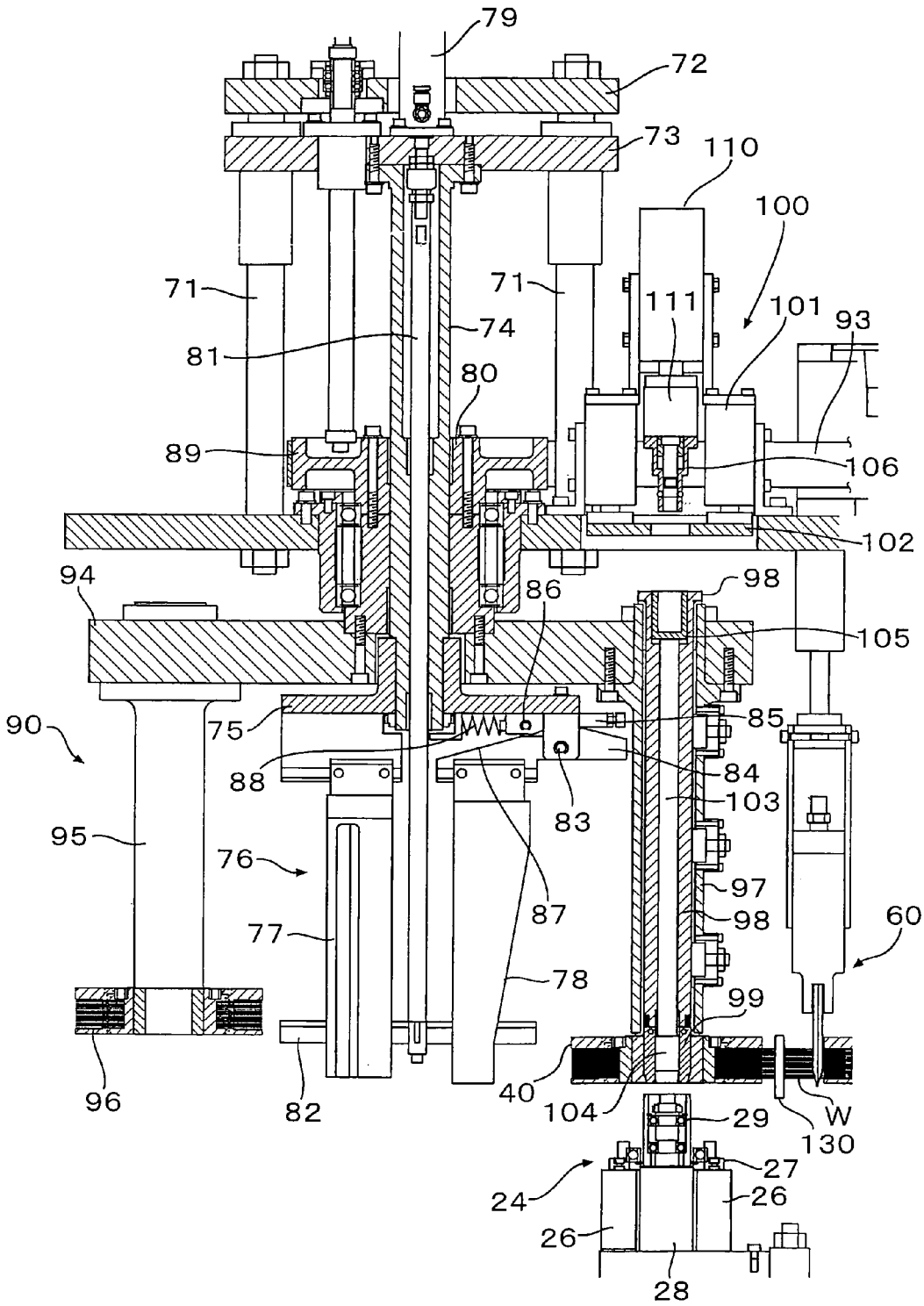
FIG. 21 is an explanatory view of a state in which the bobbin, which has undergone winding, is connected to the flyer arm, with a cutter lowered.
Figure 23:
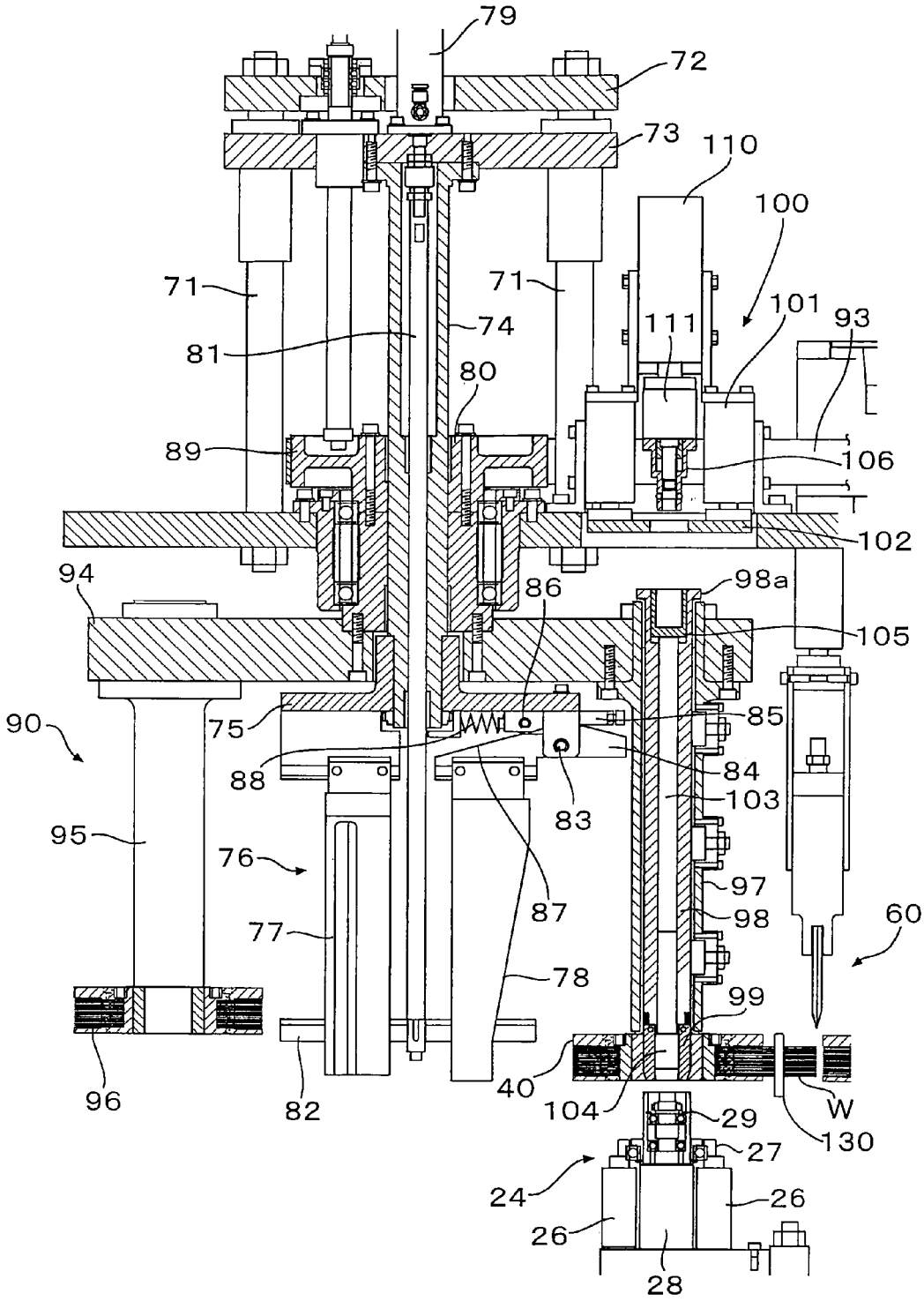
FIG. 23 is an explanatory view of a state in which the conductor wires have been cut by the cutter, and have been retreated by a predetermined distance by the conductor wire supply device.

Next, the cutter 60 descends as shown in FIGS. 21 and 22. The cutter 60 is disposed onto the portion of the conductor wires aside from the conductor wire clamp 130 on the side for the conductor wire supply device 15. In this state, as shown in FIGS. 23 and 24, the conductor wires W are cut by the cutter 60, and the conductor wires W are pulled back by the pull-back cylinder 17 of the conductor wire supply device 15, with their end portions being somewhat past the through-hole 50 of the bobbin 40.

In FIG. 24, the operation of winding the conductor wires W around the empty bobbin 40 arranged on the right-hand side with the end portions of the conductor wires W held by the clamp 54, is as already described above.

And, with the end portions of the conductor wires W being held by the conductor wire clamp 130, the bobbin 40 attached to the flyer arm 97 is rotated by the flyer 90, and winding operation on the reel 76 is started. The rotation of the flyer 90 is effected through the driving pulley 92, the timing belt 93, the driven pulley 89, and the rotary plate 94 by operating the flyer rotating motor 91 shown in FIG. 1.

Figure 25:
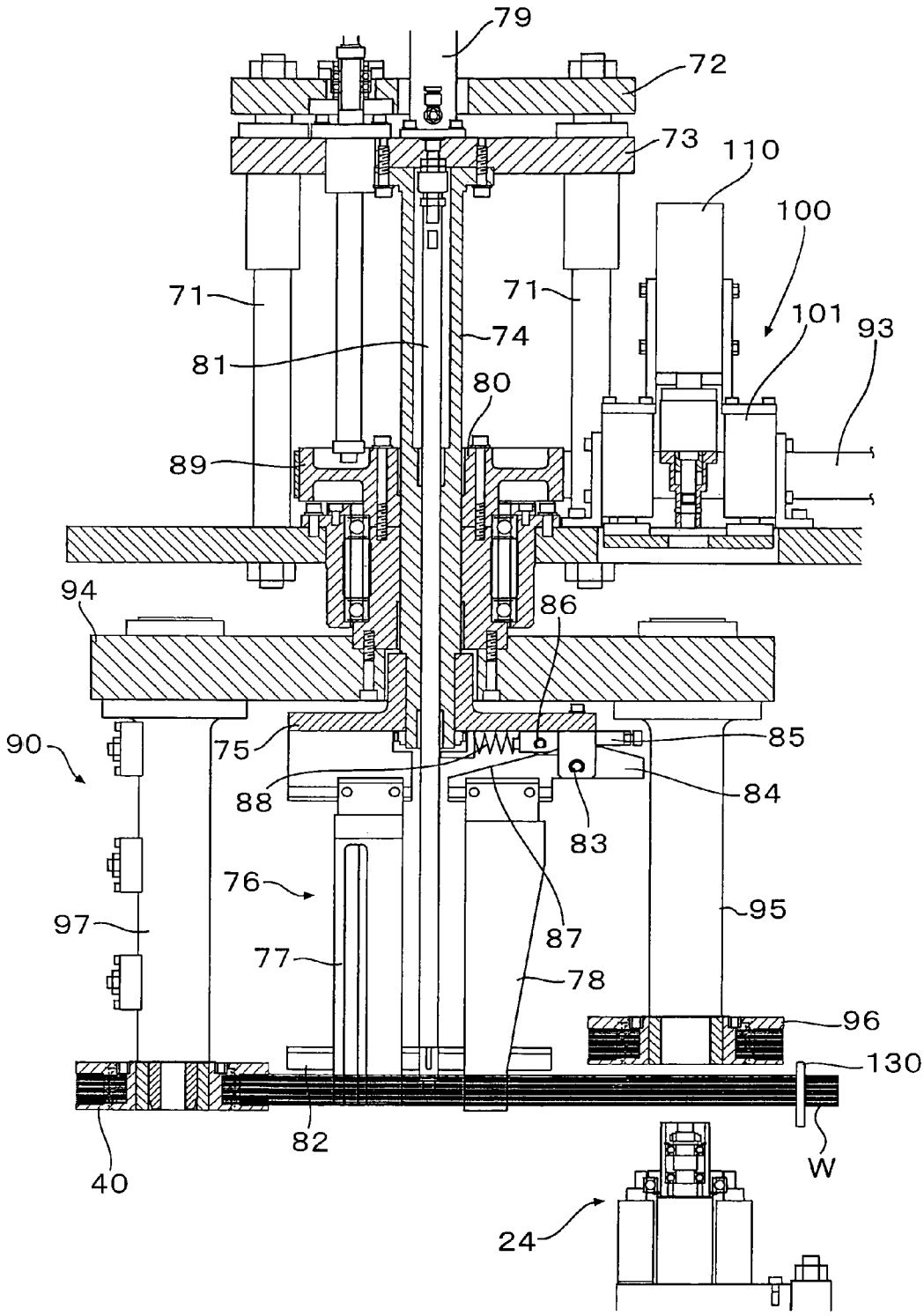
FIG. 25 is an explanatory view of a state in which the flyer arm is rotated to start to wind the conductor wires around the reel.

Further, with this winding operation, the ascent/descent plate 73 descends gradually through operation of an ascent/descent motor 73*a* shown in FIG. 1, and the reel 76 descends gradually through the support cylinder 74 connected to the ascent/descent plate 73. With the descent of the reel 76, the guide bars 122 of the coil receiving jig 120 arranged below the same are inserted into the front reel 77, and the coil wound around the reel 76 is inserted into a predetermined gap of the guide bars 122. In the state shown in FIG. 25, the flyer 90 is rotated halfway around, and the conductor wires W drawn out of the bobbin 40 have started to be wound around the lower end portion of the reel 76.

Figure 26:
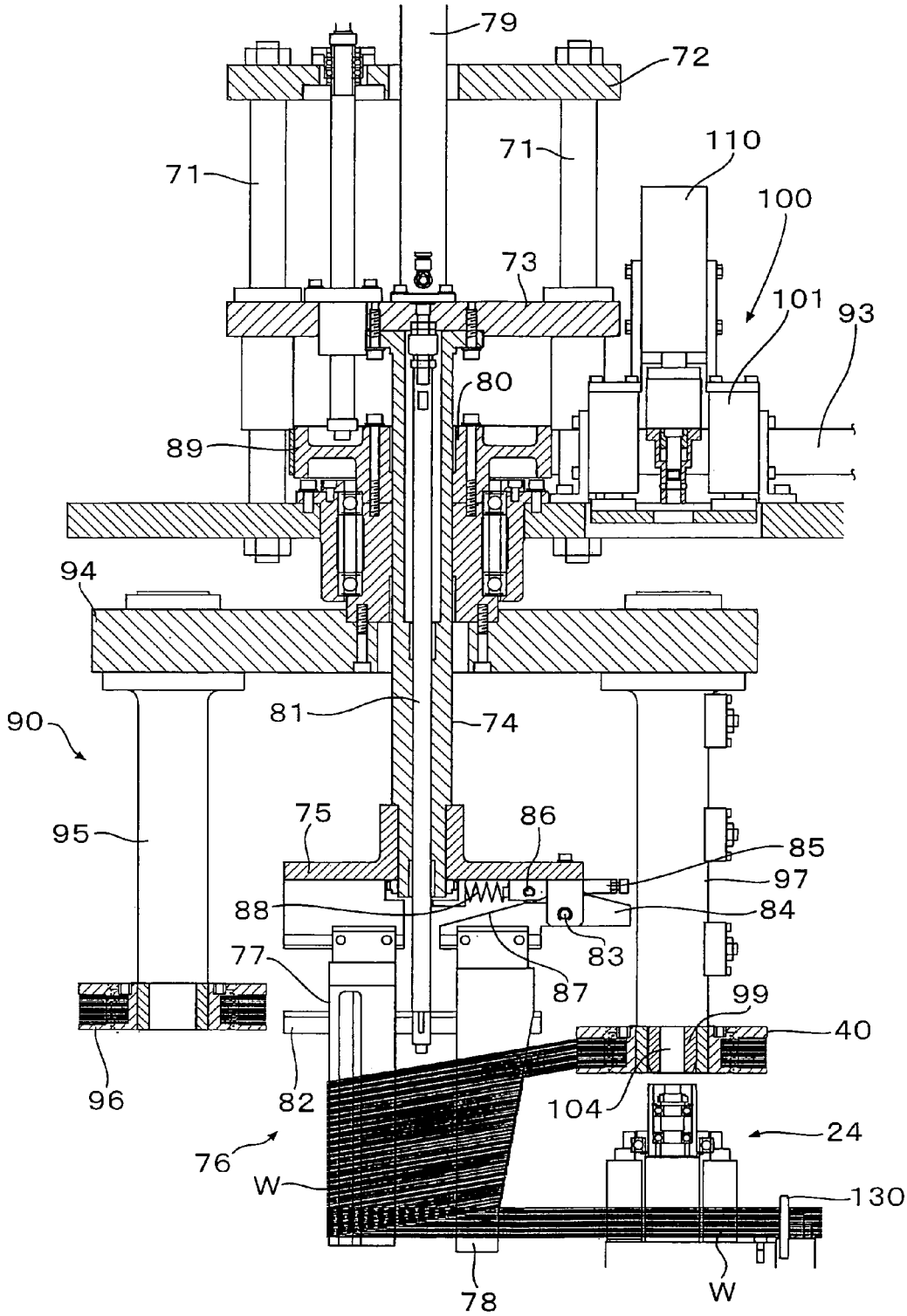
FIG. 26 is an explanatory view of a state in which the flyer arm is rotated, and in which the reel is lowered to wind the conductor wires around the reel.

As shown in FIG. 26, each time the flyer 90 makes one rotation and the conductor wires W are wound one round around the reel 76, the reel 76 descends by the width of the conductor wires W, and the conductor wires W are spirally wound from below around the reel 76 while arranged in a row. When winding for one pole has been thus completed, the rotation of the flyer 90 stops, and the slide shaft 85 mounted to the reel holder 75 is pushed in by a pusher (not shown), making the tilting plate 84 capable of tilting according to the mechanism described above; the rear reel 78 supported by the tilting plate 84 tilts inwards, and the coil wound becomes loose in the outer periphery of the reel 76.

Further, through operation of the brush-off plate air cylinder 79, the brush-off plate 82 descends, and drops the coils wound around the reel 76 entirely into the predetermined gap of the guide bars 122 of the coil receiving jig 120. As the reel 76 descends, the guide bars 122 are inserted into the front reel 77 as stated above, so that the dropping of the wound coil into the coil receiving jig 120 is effected in parallel with the winding operation; when the winding operation is completed, the brush-off plate 82 descends immediately thereafter, dropping all the coils into the coil receiving jig 120, so that the transfer of the wound coils to the coil receiving jig 120 is completed substantially simultaneously with the completion of the winding operation.

Figure 27:
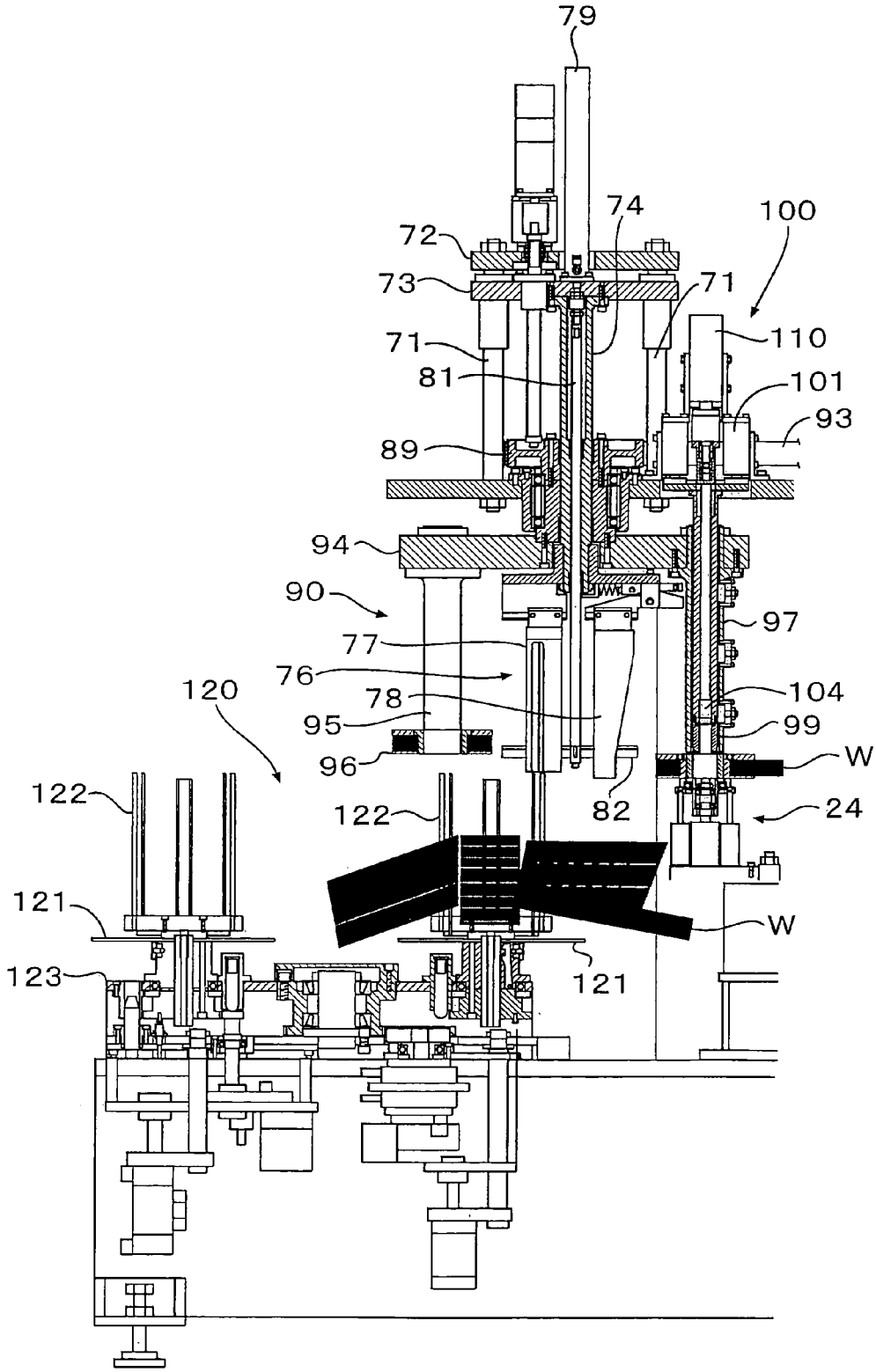
FIG. 27 is an explanatory view of a state in which coils, which have undergone winding, are retained by the coil receiving jig in the winding apparatus.

When the winding operation for one pole has been thus completed, the coil receiving jig 120 is rotated by a predetermined angle according to a driving mechanism (not shown), and another gap of the guide bars 122 is arranged at a position aligned with the reel 76, and the winding of a coil for a second pole is started. The conductor wire clamp 130 retreats and serves to clamp again the portions of the conductor wires W drawn out of the bobbin 40 at the time of the completion of the winding of the coil for the first pole, retaining the starting end portions of the conductor wires W at the time of the winding operation for the second pole. This winding operation is repeated, and, as shown in FIG. 27, the coils for the respective poles are dropped into the predetermined gaps of the guide bars 122 of the coil receiving jig 120, thus completing the winding operation.

When the winding operation is completed, the turntable 123 rotates, and an empty coil receiving jig 120 holding no coil is arranged below the reel 76. And, the coils retained by the coil receiving jig 120, making a plurality of poles, are inserted into the slot of a stator core by a known coil inserting device.

When the conductor wires W wound around one bobbin 40 have been used up by the winding operation described above, the empty bobbin 40 is restored to the support portion 24 according to the mechanism described above, and, during the winding operation thereon, a new bobbin around which conductor wires W are wound is arranged below the flyer arm 97 by the bobbin moving device 20, and a new winding operation is started.

Thus, according to the present invention, a plurality of conductor wires W are temporarily wound around a bobbin 40, then this bobbin 40 is attached to the flyer arm 97, and the flyer 90 is rotated, whereby a plurality of conductor wires W are wound around the reel 76 while drawing them out of the bobbin, so that it is possible to wind a plurality of conductor wires W around the reel 76 in parallel without any twisting. Further, the flyer 90 is rotated, and the coils W wound around the reel 76 can be successively dropped into the coil receiving jig 120 during the winding operation, and the transfer of the coils from the reel 76 to the coil receiving jig 120 can be effected simultaneously, thereby expediting the winding cycle.

According to the present invention, it is possible to provide a winding method and a winding apparatus in which a plurality of conductor wires are wound in parallel around a reel to form coils, which are dropped into a coil receiving jig. The winding method and the winding apparatus can be suitably applied to coils to be used, for example, in the motor of an electric automobile.

What is claimed is:

1. A method of winding a plurality of conductor wires arranged in parallel in which the plurality of conductor wires are wound around a reel to form a coil and the coil is dropped into a coil receiving jig, the method comprising steps of:

providing a bobbin around which the plurality of conductor wires are wound in parallel;

attaching the bobbin to flyer of winding apparatus; and revolving the flyer of the winding apparatus around the reel such that the plurality of conductor wires are drawn out of the bobbin and are wound around the reel.

2. A method according to claim 1, the method further comprising a step of moving the bobbin from a first position where the plurality of conductor wires are wound around the bobbin to a second position where the bobbin is attached to the flyer.

3. A method according to claim 1, wherein the bobbin includes separators, the separators being arranged in parallel at predetermined intervals along a rotational axis of the bobbin, thereby forming respective annular grooves, such that the plurality of conductor wires are fit into the annular grooves one by one to be wound around the bobbin.

4. A method according to claim 3, wherein the bobbin has a through-hole extending along the rotational axis of the bobbin, the through-hole being through all the separators, an inner peripheral side end portion of the through-hole extending along a radial direction is provided to reach an inner periphery of the annular grooves, such that, when the plurality of conductor wires are wound around the bobbin, starting end portions of the plurality of conductor wires are retained by a clamp inserted into the through-hole to be pressed against the inner periphery of the annular grooves.

5. A method according to claim 1, wherein two bobbins are provided, wherein a first set of the plurality of conductor wires and a second set of the plurality of conductor wires are provided for each of the two bobbins respectively, and wherein, while drawing the first set of the plurality of conductor wires out of one of the two bobbins, the other bobbin is subjected to an operation of winding the second set of the plurality of conductor wires therearound.

6. A method according to claim 5, wherein the two bobbins are provided for a set of flyer and reel such that the two bobbins are used alternately.

7. A winding apparatus comprising a reel, a flyer which is configured to revolve around the reel, and a coil receiving jig arranged below the reel, in which, by rotating the flyer, a plurality of conductor wires are wound around the reel to form a coil, and the coil is dropped into the coil receiving jig, the winding apparatus comprising:

means for winding the plurality of conductor wires in parallel around a bobbin;

means for moving the bobbin to a position for attachment to the flyer; and means for attaching or detaching the bobbin to or from the flyer, wherein the flyer is configured to rotate with the bobbin attached to the flyer such that the plurality of conductor wires are drawn out of the bobbin and are wound around the reel.

8. A winding apparatus according to claim 7, wherein the bobbin includes separators, the separators being arranged in parallel at predetermined intervals along a rotational axis of the bobbin, thereby forming respective annular grooves, such that the plurality of conductor wires are fit into the annular grooves one by one to be wound around the bobbin.

9. A winding apparatus according to claim 8, wherein the bobbin has a through-hole extending along the rotational axis of the bobbin, the through-hole being through all the separators, an inner peripheral side end portion of the through-hole extending along a radial direction is provided to reach an inner periphery of the annular grooves, and wherein the means for winding the plurality of conductor wires has a clamp which is configured to be inserted into the through-hole and to serve to retain starting end portions of the plurality of conductor wires inserted into the annular grooves, such that starting end portions of the plurality of conductor wires are retained by the clamp inserted into the through-hole to be pressed against the inner periphery of the annular grooves.

10. A winding apparatus according to claim 7, wherein the means for moving the bobbin has a plurality of support stands for supporting a plurality of bobbins, and wherein each of the support stands moves between a first position where the means for winding the plurality of conductor wires performs a winding operation, and a second position where attachment and/or detachment to and/or from the flyer are conducted, such that, while a first set of the plurality of conductor wires are drawn out of one of the bobbins to be wound around the reel, a second set of the plurality of conductor wires are wound around the other bobbin by the means for winding conductor wires.

11. A winding apparatus according to claim 10, wherein the means for moving the bobbin has a rotary table with two support stands for supporting the bobbins, and wherein the two support stands move alternately by a rotational movement of the rotary table between the first position and the second position.

12. A method of winding a plurality of conductor wires arranged in parallel in which the conductor wires are wound around a reel to form a coil and the coil is dropped into a coil receiving jig, the method comprising steps of;

(a) providing a bobbin around which the conductor wires are wound; and (b) revolving a flyer of a winding apparatus around the reel in a state in which the bobbin is attached to the flyer, the bobbin being wound the conductor wires around, such that the conductor wires are drawn out of the bobbin to be wound around the reel, wherein the bobbin is constituted of separators, the separators being arranged in parallel at predetermined intervals along a rotational axis of the bobbin, thereby forming respective annular grooves, such that the conductor wires are fit into the annular grooves one by one to be wound around the bobbin.

13. A method according to claim 12, wherein the bobbin has a through-hole extending along the rotational axis of the bobbin, the through-hole being through all the separators, an inner peripheral side end portion of the through-hole extending along a radial direction is provided to reach an inner periphery of the annular grooves, such that, when the conductor wires are wound around the bobbin, starting end portions of the conductor wires are retained by a clamp inserted into the through-hole to be pressed against the inner periphery of the annular grooves.

14. A method of winding a plurality of conductor wires arranged in parallel in which the conductor wires are wound around a reel to form a coil and the coil is dropped into a coil receiving jig, the method comprising steps of;

(a) providing a bobbin around which the conductor wires are wound; and (b) revolving a flyer of a winding apparatus around the reel in a state in which the bobbin is attached to the flyer, the bobbin being wound the conductor wires around, such that the conductor wires are drawn out of the bobbin to be wound around the reel, wherein a plurality of bobbins are provided, wherein sets of the conductor wires are provided for each of the bobbins respectively, and wherein, while drawing the conductor wires out of one of the bobbins, the other bobbin is subjected to an operation of winding thereabout.

15. A method according to claim 14, wherein the two bobbins are provided for a set of flyer and reel such that the bobbins are used alternately.

16. A winding apparatus comprising a reel, a flyer which is configured to revolve around the reel, and a coil receiving jig arranged below the reel, in which, by rotating the flyer, a plurality of conductor wires are wound around the reel to form a coil, and the coil is dropped into the coil receiving jig, the winding apparatus comprising:

a means for winding conductor wires, thereby the conductor wires being arranged in parallel around a bobbin;

a means for moving the bobbin, thereby the bobbin being moved to a position for attachment to the flyer; and a means for attaching and/or detaching the bobbin to and/or from the flyer, wherein the flyer rotates in a state in which the bobbin is attached to the flyer, the bobbin being wound the conductor wires around, such that the conductor wires are drawn out of the bobbin to be wound around the reel, and wherein the bobbin is constituted of separators, the separators being arranged in parallel at predetermined intervals along a rotational axis of the bobbin, thereby forming respective annular grooves, such that the conductor wires are fit into the annular grooves one by one to be wound around the bobbin.

17. A winding apparatus according to claim 16, wherein the bobbin has a through-hole extending along the rotational axis of the bobbin, the through-hole being through all the separators, an inner peripheral side end portion of the through-hole extending along a radial direction is provided to reach an inner periphery of the annular grooves, and wherein the means for winding conductor wires has a clamp which is configured to be inserted into the through-hole and to serve to retain starting end portions of the conductor wires inserted into the annular grooves, such that starting end portions of the conductor wires are retained by the clamp inserted into the through-hole to be pressed against the inner periphery of the annular grooves.

18. A winding apparatus comprising a reel, a flyer which is configured to revolve around the reel, and a coil receiving jig arranged below the reel, in which, by rotating the flyer, a plurality of conductor wires are wound around the reel to form a coil, and the coil is dropped into the coil receiving jig, the winding apparatus comprising:

a means for winding conductor wires, thereby the conductor wires being arranged in parallel around a bobbin;

a means for moving the bobbin, thereby the bobbin being moved to a position for attachment to the flyer; and a means for attaching and/or detaching the bobbin to and/or from the flyer, wherein the flyer rotates in a state in which the bobbin is attached to the flyer, the bobbin being wound the conductor wires around, such that the conductor wires are drawn out of the bobbin to be wound around the reel, wherein the means for moving the bobbin has a plurality of support stands for supporting the bobbins, and wherein each of the support stands moves between a first position where the means for winding conductor wires performs a winding operation, and a second position where attachment and/or detachment to and/or from the flyer are conducted, such that, while a set of the conductor wires are drawn out of one of the bobbins to be wound around the reel, other set of conductor wires are wound around the other bobbin by the means for winding conductor wires.

19. A winding apparatus according to claim 18, wherein the means for moving the bobbin has a rotary table with two support stands for supporting the bobbins, and wherein the two support stands move alternately by a rotational movement of the rotary table between the first position and the second position.

* * * * *